US012116238B2

(12) United States Patent
Huang

(10) Patent No.: US 12,116,238 B2
(45) Date of Patent: Oct. 15, 2024

(54) LACING DEVICE AND ANTI-REVERSE MECHANISM THEREOF

(71) Applicant: SHENZHEN ICOMWELL INTELLIGENT MEDICAL TECHNOLOGY CO., LTD., Shenzhen (CN)

(72) Inventor: Wei Huang, Shenzhen (CN)

(73) Assignee: SHENZHEN ICOMWELL INTELLIGENT MEDICAL TECHNOLOGY CO., LTD., Shenzhen (CN)

( * ) Notice: Subject to any disclaimer, the term of this patent is extended or adjusted under 35 U.S.C. 154(b) by 68 days.

(21) Appl. No.: 17/956,895

(22) Filed: Sep. 30, 2022

(65) Prior Publication Data

US 2023/0234809 A1 Jul. 27, 2023

(30) Foreign Application Priority Data

Jan. 21, 2022 (CN) ..... 202210068932.4

(51) Int. Cl.
*B65H 75/44* (2006.01)
*A43C 11/16* (2006.01)

(52) U.S. Cl.
CPC ..... *B65H 75/4492* (2013.01); *A43C 11/165* (2013.01); *B65H 2701/30* (2013.01)

(58) Field of Classification Search
CPC ... A43C 11/16; A43C 11/165; B65H 75/4428; B65H 75/4434; B65H 75/4492; B65H 2403/47; B65H 2701/30; B65H 75/48; B65H 75/483; B65H 75/486
See application file for complete search history.

(56) References Cited

U.S. PATENT DOCUMENTS 4,870,723 A * 10/1989 Pozzobon ..... A43C 11/16 36/117.7
6,257,382 B1 * 7/2001 Liao ..... H04M 1/15 191/12.2 R
6,375,109 B1 * 4/2002 Liao ..... H04M 1/15 242/378
8,516,662 B2 * 8/2013 Goodman ..... A43C 11/165 36/50.5
9,101,181 B2 * 8/2015 Soderberg ..... A43C 11/165
9,408,437 B2 * 8/2016 Goodman ..... B65H 75/4431
(Continued)

FOREIGN PATENT DOCUMENTS

CN 107055221 B * 7/2018 ..... B65H 75/4492
CN 208993976 U 6/2019
(Continued)

*Primary Examiner* — Michael R Mansen
*Assistant Examiner* — Raveen J Dias
(74) *Attorney, Agent, or Firm* — Bayramoglu Law Offices LLC

(57) ABSTRACT

A novel lacing device and an anti-reverse mechanism thereof are provided. The lacing device uses a novel swing arm-stop piece-gap mechanism as the anti-reverse mechanism, and the anti-reverse mechanism has double self-locking functions and a reverse deviation limiting function. Three effects are integrated, such that the lacing device using the novel anti-reverse mechanism not only has excellent hand feeling when the lace is tensioned, but also can effectively avoid the accidental loosening of the lace, and has excellent use reliability and durability.

20 Claims, 8 Drawing Sheets

(56) References Cited

U.S. PATENT DOCUMENTS 9,486,039 B2 * 11/2016 Ha ..... A42B 1/22
9,511,975 B2 * 12/2016 Grenet ..... A43C 11/165
9,681,705 B2 * 6/2017 Trudel ..... A43C 7/00
9,706,814 B2 * 7/2017 Converse ..... A61F 5/0123
10,368,613 B2 * 8/2019 Ha ..... A43C 7/00
10,413,019 B2 * 9/2019 Soderberg ..... A43C 11/165
10,856,620 B2 * 12/2020 Huang ..... A43C 11/165
10,952,503 B2 * 3/2021 Trudel ..... A43C 7/00
10,993,504 B1 * 5/2021 Li ..... A43C 11/165
11,033,003 B1 * 6/2021 Burkhardt ..... B65H 75/486
11,122,865 B2 * 9/2021 Burt ..... A43C 11/20
11,297,903 B2 * 4/2022 Soderberg ..... A43C 11/165
11,492,228 B2 * 11/2022 Kruse ..... A43C 11/165
11,607,014 B2 * 3/2023 Chen ..... A43C 11/165
11,633,018 B2 * 4/2023 Burt ..... E05C 3/145
242/395
11,638,466 B2 * 5/2023 Burt ..... A43C 11/165
24/195
11,758,982 B2 * 9/2023 Burt ..... E05C 3/122
242/395
11,771,179 B2 * 10/2023 Kim ..... A41F 1/06
24/68 R
11,805,856 B2 * 11/2023 Chen ..... A43C 11/20
11,806,264 B2 * 11/2023 Miller ..... A61F 5/0125
11,849,809 B1 * 12/2023 Xiang ..... B65H 75/30
11,896,088 B1 * 2/2024 Peng ..... A43C 11/165
11,919,740 B2 * 3/2024 Kruse ..... B65H 75/30
2007/0084956 A1 * 4/2007 Chen ..... A43C 7/00
242/388.6
2010/0139057 A1 * 6/2010 Soderberg ..... A43C 11/16
242/396.2
2011/0266384 A1 * 11/2011 Goodman ..... B65H 75/4431
29/434
2013/0025100 A1 * 1/2013 Ha ..... A43C 11/165
24/712.9
2013/0092780 A1 * 4/2013 Soderberg ..... A43C 11/165
242/397
2014/0117140 A1 * 5/2014 Goodman ..... A43C 11/165
29/434
2015/0014463 A1 * 1/2015 Converse ..... A43C 11/165
242/396.1
2015/0076272 A1 * 3/2015 Trudel ..... A43C 11/165
242/381.4
2015/0313319 A1 * 11/2015 Ha ..... A43C 11/165
24/712
2015/0342303 A1 * 12/2015 Soderberg ..... A43C 11/165
24/68 SK
2016/0009524 A1 * 1/2016 Grenet ..... B65H 75/4492
242/395
2016/0120267 A1 * 5/2016 Burns ..... A43C 7/00
24/68 C
2017/0027287 A1 * 2/2017 Burns ..... A43B 13/14
2017/0295888 A1 * 10/2017 Chen ..... A43C 11/165
2017/0311682 A1 * 11/2017 Trudel ..... F16G 11/12
2017/0325548 A1 * 11/2017 Ha ..... A43C 11/165
2019/0000187 A1 * 1/2019 Chen ..... A43C 7/00
2019/0008236 A1 * 1/2019 Ha ..... A43C 11/165
2019/0144150 A1 * 5/2019 Chen ..... A43C 11/165
100/32
2019/0150569 A1 * 5/2019 Chen ..... A43C 11/00
2019/0174872 A1 * 6/2019 Kawano ..... A43B 5/04
2019/0200706 A1 * 7/2019 Huang ..... A43C 1/00
2019/0293945 A1 * 9/2019 Chang ..... G02B 27/0176
2019/0343235 A1 * 11/2019 So ..... A43C 7/08
2020/0054097 A1 * 2/2020 Soderberg ..... A43C 11/165
2020/0087104 A1 * 3/2020 Wang ..... B65H 75/4415
2020/0128918 A1 * 4/2020 Chen ..... A43C 7/08
2020/0128919 A1 * 4/2020 Burt ..... E05C 3/122
2020/0345107 A1 * 11/2020 Burt ..... A43C 17/02
2020/0346888 A1 11/2020 Kruse et al.
2021/0037926 A1 * 2/2021 Kim ..... A43C 7/08
2021/0177098 A1 * 6/2021 Trudel ..... F16G 11/12
2021/0186159 A1 * 6/2021 Hu ..... A43C 1/06
2021/0251343 A1 * 8/2021 Martin ..... A43C 11/165
2021/0284483 A1 * 9/2021 Chen ..... A43C 11/165
2021/0289889 A1 * 9/2021 Chen ..... B65H 75/48
2021/0401121 A1 * 12/2021 Kim ..... A41F 1/008
2022/0265001 A1 * 8/2022 Burt ..... A43C 1/00
2022/0346502 A1 * 11/2022 Soderberg ..... A43C 11/165
2023/0172318 A1 * 6/2023 Burt ..... F16D 3/52
242/395
2023/0200356 A1 * 6/2023 Chen ..... B65H 75/406
119/796
2023/0248116 A1 * 8/2023 Duller ..... A43C 11/165
24/68 SK
2023/0404214 A1 * 12/2023 Kim ..... A45C 13/30
2024/0032654 A1 * 2/2024 Chen ..... F16G 11/12
2024/0074541 A1 * 3/2024 Converse ..... A43B 3/38

FOREIGN PATENT DOCUMENTS

CN 111003616 A * 4/2020 ..... A43C 9/00
CN 215423119 U 1/2022
CN 215501560 U 1/2022
CN 216272500 U 4/2022
CN 115413863 A * 12/2022 ..... A43C 11/165
EP 4316303 A1 * 2/2024 ..... A43C 11/08
FR 3051334 A1 * 11/2017 ..... A43C 11/165
JP 2015000293 A 1/2015
JP 2016504108 A 2/2016
JP 2016036679 A 3/2016
JP 2016539750 A 12/2016
JP 2022530682 A 6/2022
KR 101607690 B1 * 3/2016 ..... A43C 11/165
WO WO-2017034222 A2 * 3/2017 ..... A41C 3/12
WO 2018169174 A1 9/2018
WO WO-2020209582 A1 * 10/2020 ..... A43C 11/165

* cited by examiner

G. 8A

IG. 10A

LACING DEVICE AND ANTI-REVERSE MECHANISM THEREOF

CROSS REFERENCE TO RELATED APPLICATION

The present application is based upon and claims the priority to Chinese Patent Application 202210068932.4, filed on Jan. 21, 2022, the entire contents of which are incorporated herein by reference.

TECHNICAL FIELD

The present disclosure relates to the technical field of lacing systems, and in particular, to a novel lacing device and an anti-reverse mechanism thereof.

BACKGROUND

At present, most lacing devices on the market use a housing tooth-pawl structure to achieve unidirectional rotation of the lacing mechanism. The elastic arm of this structure is subjected to flexural deformation to achieve unidirectional rotation, and to prevent reverse rotation based on the mechanism thereof preventing material buckling. Once a pawl arm buckles, the structure fails. Other anti-reverse mechanisms either have the problem of hard and laborious use, or the problem of poor anti-reverse capability.

Therefore, there is an urgent need for a lacing device with a novel anti-reverse mechanism, which not only has excellent usability, but also has excellent anti-reverse reliability.

SUMMARY

The present disclosure provides a novel lacing device and an anti-reverse mechanism thereof. A novel swing arm-stop piece mechanism is used as the anti-reverse mechanism. A swing arm head and a wedge-shaped head of a stop piece form a reverse self-locking system, which can greatly enhance the anti-reverse reliability of the lacing device.

A novel lacing device includes: a rotatable cover, a spool, and a housing. The rotatable cover is rotatably arranged on the housing, and the spool is supported by the housing, and is rotatable relative to the housing.

The rotatable cover is provided with one or more gaps.

The spool is configured to roll up a lace when rotating in a tensioning direction and release the lace when rotating in a loosening direction.

The housing is provided with a swing arm elastic component. The swing arm elastic component includes an elastic member and one or more swing arms arranged along a circumference. The swing arm is connected to the housing through the elastic member. The swing arm includes at least a swing arm head and a swing arm beam. The swing arm beam extends outward in a radial direction of the circumference of the one or more swing arms. The swing arm includes opposite first and second sides. The swing arm head is configured to engage the gap of the rotatable cover when the swing arm is in an original position. The swing arm beam and/or the swing arm head are/is configured to deviate from the original position towards the first or second side of the same swing arm.

The housing is further provided with one or more stop pieces, and the stop piece is located on the first side of the swing arm. The stop piece includes a wedge-shaped head, and the wedge-shaped head of the stop piece is arranged corresponding to the swing arm head.

When the rotatable cover is subjected to an external force in the tensioning direction, the stop piece and the elastic member allow relative displacement of the swing arm and the gap of the rotatable cover until the swing arm head is disengaged from the gap of the rotatable cover to allow the rotatable cover to rotate in the tensioning direction.

When the rotatable cover is subjected to an external force in the loosening direction, the external force in the loosening direction causes a side wall of the gap of the rotatable cover to exert bias pressure on the swing arm head to deviate the swing arm head, such that at least part of the swing arm head abuts against the wedge-shaped head of the stop piece, and the swing arm head always remains engaged with the gap of the rotatable cover to prevent the rotatable cover from rotating in the loosening direction.

The deviation includes deflection, swing or bending, and the deviation movement causes the swing arm head to be no longer in the original position but to be inclined or bent to a certain degree.

In the above technical solution, the deviation direction of the swing arm to the first side is the same as a direction of applying a force to the rotatable cover in the loosening direction. The first side and the second side of the whole swing arm are exactly the same as the first side and the second side of the swing arm head or the swing arm beam. The tooth portion of the swing arm head also includes a first side and a second side, and the first and second sides of the tooth portion are oriented in the same direction as the first and second sides of the swing arm or swing arm beam. For example, taking a central axis of the swing arm beam as the reference, a left side of the central axis is the first side, and a right side of the central axis is the second side. Similarly, taking a central axis of the swing arm tooth as the reference, a left side of the central axis is the first side, and a right side of the central axis is the second side. In another way, if a position where the swing arm tooth is engaged with the gap of the rotatable cover is called the original position, a direction of rotating the rotatable cover in the loosening direction is called the first sides of the swing arm tooth, the swing arm neck, the swing arm beam, and the swing arm, and a direction of rotating the rotatable cover in the tensioning direction is called the second sides of the swing arm tooth, the swing arm neck, the swing arm beam, and the swing arm. The first side and the second side are respectively located on both sides of the original position.

The expression that "the swing arm beam and/or the swing arm head are/is configured to deviate from the original position towards the first side of the same swing arm" includes at least one of the following three technical solutions: the swing arm beam and the swing arm head are both deviated from the original position to the first side of the swing arm, the swing arm beam is inclined from the original position to the first side of the swing arm, and the swing arm head is inclined from the original position to the first side of the swing arm. Similarly, the expression that "the swing arm beam and/or the swing arm head are/is configured to deviate from the original position towards the second side of the same swing arm" includes at least one of the following three technical solutions: the swing arm beam and the swing arm head are both deviated from the original position to the second side of the swing arm, the swing arm beam is inclined from the original position to the second side of the swing arm, and the swing arm head is inclined from the original position to the second side of the swing arm.

Preferably, the stop piece and the swing arm may be arranged in one-to-one correspondence.

Preferably, the stop piece and the swing arm may be arranged separately.

Preferably, the stop piece may further include a base portion, and the base portion of the stop piece may be arranged corresponding to the swing arm beam.

When the rotatable cover is not subjected to the external force and the swing arm head is engaged with the gap of the rotatable cover, the swing arm is in the original position, and the swing arm in the original position is in a state of natural extension (namely: the swing arm beam and the swing arm head are both in the original position and are in a state of natural extension). When the rotatable cover is subjected to the external force, in the process of the swing arm beam and/or the swing arm head being deviating from the original position towards the first or second side, the swing arm beam and/or the swing arm head are/is in a state of deviating from the original position.

Preferably, the swing arm may be configured to have a gap with the stop piece when it is in the original position.

The swing arm is configured to have a gap with the stop piece when it is in the original position, and with the gap, the stop piece does not hinder the movement of the swing arm when the rotatable cover is subjected to the external force in the tensioning direction, such that the swing arm head can be disengaged from the gap of the rotatable cover. The gap between the wedge-shaped head of the stop piece and the swing arm head is very important for the disengagement of the swing arm head from the gap.

When the rotatable cover is subjected to the external force in the tensioning direction, the external force in the tensioning direction causes the side wall of the gap to exert bias pressure on the swing arm head, a biasing force is transmitted to the elastic member through the swing arm, the biasing force applied by the side wall of the gap includes a radial component force and a circumferential component force, and the elastic member will elastically deform under the action of the radial component force to drive the swing arm to move radially inward. The circumferential component force mainly acts on the swing arm head, the direction is the same as that of the circumferential component of the external force in the tensioning direction, and the stop piece does not prevent the swing arm from being deviating towards the tensioning direction, such that the circumferential component force causes the swing arm to be subjected to circumferential deviation (including flexural deformation, swing, or deflection). Therefore, under the action of the external force in the tensioning direction, the displacement of the swing arm includes a radially inward displacement component and a circumferential displacement component in the tensioning direction. The expression "the side wall of the gap biasing the swing arm head (or swing arm)" means that a pressure point on the swing arm head (or swing arm) is deviated from an axis of the swing arm head (or swing arm), making the swing arm head (or swing arm) both compressed and bent.

The external force in the loosening direction causes the side wall of the gap to exert bias pressure on the swing arm head to deviate the swing arm head toward the first side, such that at least part of the swing arm head abuts against the wedge-shaped head of the stop piece.

Preferably, when at least part of the swing arm head abuts against the wedge-shaped head of the stop piece, the wedge-shaped head of the stop piece may apply an extrusion force to the swing arm head. The extrusion force may include a radially outward component force, and the radially outward component force may always keep the swing arm head abutting against the gap of the rotatable cover. The extrusion force applied by the wedge-shaped head of the stop piece to the swing arm head is also a biasing force.

Preferably, the swing arm head may include a tooth portion and a neck portion, and when the swing arm is in the original position, the tooth portion of the swing arm head may be engaged with the gap of the rotatable cover.

Preferably, at least part of the neck portion of the swing arm head may abut against the wedge-shaped head of the stop piece when the rotatable cover is subjected to the external force in the loosening direction.

Preferably, at least part of the neck portion of the swing arm head abutting against the wedge-shaped head of the stop piece may include a first side surface of the neck portion of the swing arm head abutting against the wedge-shaped head of the stop piece or part of the first side surface of the neck portion of the swing arm head abutting against the wedge-shaped head of the stop piece.

The neck portion of the swing arm head may also be referred to as "the neck portion" and "the swing arm neck". The tooth portion of the swing arm head may be referred to as "the tooth portion" and "the swing arm tooth".

The expression "the first side surface of the neck portion" refers to the side wall surface located on the first side of the neck portion. When the rotatable cover is subjected to the external force in the loosening direction, the external force in the loosening direction causes the side wall of the gap to exert bias pressure on the swing arm head, and the direction of the biasing force is basically the same as that of the external force in the loosening direction, which constitutes a bending force acting on the swing arm head. The biasing force deviates the swing arm head in the direction of the external force in the loosening direction, causing at least part of the side surface of the neck portion of the swing arm head to abut against the wedge-shaped head of the stop piece, and then the wedge-shaped head of the stop piece applies an extrusion force on the side surface of the swing arm neck. The extrusion force includes a radially outward component force and a circumferential component force, and the circumferential component force and the biasing force on the swing arm head belong to opposite forces. Therefore, the circumferential component force can deviate at least part of the biasing force acting on the swing arm head, and the radially outward component force makes the tooth portion of the swing arm head more close to the gap of the rotatable cover, such that the tooth portion of the swing arm head can always remain engaged with the gap of the rotatable cover, so as to prevent the rotatable cover from rotating in the loosening direction.

Preferably, a slope surface of the wedge-shaped head of the stop piece may be located on a second side of the wedge-shaped head.

Preferably, the slope surface of the wedge-shaped head of the stop piece may be adjacent to a first side of the neck portion of the swing arm head, and a slope top of the slope surface may be deviated to a first side of the wedge-shaped head relative to a slope toe. The slope toe of the wedge-shaped head may be adjacent to the base portion of the stop piece.

Preferably, the slope surface of the wedge-shaped head may be configured such that when the rotatable cover is subjected to the external force in the loosening direction, the swing arm head is inclined to its first side, such that at least part of the first side surface of the neck portion abuts against the slope surface of the wedge-shaped head.

Preferably, the neck portion of the swing arm head may be configured in a fan ring shape or a trapezoid shape.

Preferably, one side of the neck portion of the swing arm head adjacent to the slope surface of the wedge-shaped head may be arranged as a tapered plane, and the other side may be arranged as an arc-shaped concave surface.

Preferably, the whole of the neck portion of the swing arm head and the swing arm beam may be arranged in a shape similar to an axe.

The structural design of the swing arm neck is to meet functional requirements of matching with the slope surface of the wedge-shaped head of the stop piece, and to realize smooth transition between the tooth portion and the swing arm beam, so as to ensure that each component can fully play its role and from an organically coordinated whole.

Preferably, the swing arm head may include one or more tooth portions.

More preferably, the swing arm head may include two tooth portions. A swing arm with two tooth portions has more excellent anti-reverse effects than a swing arm with only a single tooth portion.

The swing arm beam is a slender structure to ensure its excellent swing elasticity, and when there are a large number of tooth portions, the swing arm tooth tends to be thick, so the transition connection of the neck portion is required to make the tooth portion of the swing arm smoothly transition to the slender swing arm beam.

Preferably, the tooth portion and the neck portion of the swing arm head may be integrally formed.

Preferably, the swing arm head and the swing arm beam may be integrally formed.

Preferably, the first side surface of the neck portion may be in parallel with the slope surface of the wedge-shaped head of the stop piece.

Preferably, the first side surface of the neck portion may be located on a first side in a radial direction of the swing arm, and the top of the first side surface may be deviated to the first side of the swing arm relative to the bottom thereof. The top of the first side surface of the neck portion refers to a connection point between the neck portion and the tooth portion, and the bottom refers to the connection point between the neck portion and the swing arm beam. In this way, after the wedge-shaped head of the stop piece abuts against the first side surface of the neck portion, the force applied by the wedge-shaped head to the first side of the neck portion has a radially upward component force, and under the action of the radially upward component force, the swing arm head will be self-locking in an opposite direction with the gap.

Preferably, the first side surface of the neck portion and a first tooth wall of the tooth portion may be perpendicular or have an included angle in a range of 60°-120°. The first tooth wall refers to a side wall located on the first side of the tooth portion.

Preferably, when the swing arm head includes one or more tooth portions, a tooth portion adjacent to the first side surface of the neck portion of the swing arm head may be a first tooth portion.

More preferably, the first side surface of the neck portion and a first tooth wall of the first tooth portion may be perpendicular to each other. The design of the relative included angle between the slope surface of the wedge-shaped head and the side surface of the neck portion makes the biasing force on the first tooth wall of each tooth portion from the gap of the rotatable cover parallel or substantially parallel to the slope surface of the wedge-shaped head of the stop piece. Under the action of the biasing force, even if the elastic member drives the swing arm to move radially inward, the deviation trend of the swing arm head is basically the same as the inclination of the slope surface of the wedge-shaped head of the stop piece. The gap between the swing arm head and the wedge-shaped head is basically unchanged, such that the wedge-shaped head of the stop piece does not hinder the deviation displacement of the swing arm head, and the tooth portion of the swing arm can be disengaged from the gap of the rotatable cover. Since the included angle of the first tooth walls of one or more tooth portions on the swing arm head is small, when the first tooth wall of the first tooth portion and the first side surface of the swing arm neck are perpendicular to each other, the first tooth walls of the other tooth portions are also substantially perpendicular to the first side surface of the swing arm neck. Therefore, the biasing force on the first tooth walls of the other tooth portions from the gap of the rotatable cover is substantially parallel to the slope surface of the wedge-shaped head of the stop piece.

Preferably, when the rotatable cover is subjected to the external force in the loosening direction, the external force in the loosening direction may cause the side wall of the gap to exert bias pressure on the swing arm head to deviate the swing arm head, at least part of the swing arm head may abut against the wedge-shaped head of the stop piece, and the base portion of the stop piece may prevent the swing arm beam from deviating towards its first side, such that the tooth portion of the swing arm may always remain engaged with the gap of the rotatable cover to prevent the rotatable cover and the spool from rotating in the loosening direction.

For the conventional swing arm elastic component-stop piece-gap mechanism, due to the strong deformation ability of the elastic member, the swing arm is driven to move to give way. When the user tensions the lace by rotating the rotatable cover, the operation is labor-saving and the feeling of use is excellent. However, the anti-reverse ability of the lacing mechanism also deteriorates, because in the conventional swing arm structure, only the base portion of the stop piece has a deviation limiting effect on the swing arm beam. Due to the strong deformation ability of the elastic member, in the lacing mechanism, under the action of a large external force in the loosening direction, the connection point between the swing arm and the elastic member is prone to large-scale deviation and displacement, resulting in the disengagement of the tooth portion of the swing arm and the gap of the rotatable cover, and the lacing mechanism cannot prevent anti-reversal under the action of the large external force in the loosening direction, which greatly reduces the use reliability of the lacing mechanism.

In the present disclosure, the swing arm and the stop piece both use a novel structure design, and the self-locking design of the neck portion of the swing arm head and the wedge-shaped head of the stop piece can further enhance the anti-reverse function of the lacing device. When the rotatable cover is subjected to the external force in the loosening direction, the side wall of the gap of the rotatable cover exerts bias pressure on the tooth portion of the swing arm, such that the swing arm head is inclined from the original position to the first side, and the swing arm beam is forced to tend to be deviated from the original position to the first side. However, the deviation of the swing arm neck causes the first side surface to abut against the wedge-shaped head of the stop piece and then be subjected to the extrusion force from the wedge-shaped head, which makes the tooth portion of the swing arm head further close to the gap of the rotatable gap to from reverse self-locking, that is, the wedge-shaped head of the stop piece and the neck portion of the swing arm head form reverse self-locking. The base portion of the stop piece limits the swing arm beam to swinging or deviating towards its first side at the same time. Under the dual action of reverse self-locking and swing limit, the swing arm head cannot be disengaged from the gap of the rotatable cover, such that the rotatable cover and the spool cannot rotate in the loosening direction.

Preferably, the housing may be provided with one or more swing arms along a circumference, and the tooth portion of the swing arms may protrude radially outward along the circumference. The expression "one or more swing arms arranged along the circumference" means that tail ends of the swing arms are located on the same circumference. The tail ends of the swing arms include a tail end of a free end of the swing arm beam and/or a tail end of the tooth portion of the swing arm head.

The expression that "the swing arm head is configured to engage the gap of the rotatable cover when the swing arm is in an original position, and the swing arm beam and/or the swing arm head are/is configured to deviate from the original position towards the first or second side of the same swing arm" means that in the present disclosure, without a stop piece, the swing arm structure is configured to deviate towards both sides of the original position, such that the gap can rotate in the tensioning direction and in the loosening direction. It is because without a stop piece, the swing arm can be deviated from its original position to both sides, similar to a swinging motion, so it is named the swing arm.

Preferably, the one or more gaps may be distributed along the circumference. The gap of the present disclosure includes a top and an open end. The open end faces the inner side of the circumference. The open end of the gap includes two end points. The end point corresponding to the first side of the swing arm tooth is called a first end point. The end point corresponding to the second side of the swing arm tooth is called a second end point. A swing arm tooth tip corresponding to the top of the gap is the tail end of the tooth portion of the swing arm head.

Preferably, teeth are formed along a circumference of the rotatable cover. The teeth protrude toward an inside of the circumference. A space between adjacent teeth forms the gap.

Preferably, the first end point and the second end point of each gap may be located on the same circumference. This circumference is hereinafter referred to as "the circumference of the end point of the gap". This is known as having one or more gaps distributed along the circumference.

Preferably, the central axis of the swing arm may coincide with or be parallel to a certain radius of the circumference of the end point of the gap.

Preferably, the gap may be an asymmetric gap, and the asymmetric gap may include a first side wall and a second side wall.

Preferably, a straight line where the second side wall of the asymmetric gap extends along and a radius through the second end point of the circumference of the end point of the gap may have an included angle in a range of 0°-10°.

More preferably, the straight line of the second side wall of the asymmetric gap may extend in the direction of the radius corresponding to the second end point on the circumference of the end point of the gap.

In the present disclosure, when the straight line of the second side wall of the gap and the radius corresponding to the second end point on the circumference of the end point of the gap have an included angle being a positive acute angle, the positive acute angle means that the second side wall is located on the second side of the radius of the circumference.

The second side wall coincides with the radius or has an included angle within 10° with the radius, such that the force applied by the second side wall to the swing arm tooth is mainly a bending force, or there is some radially outward component force, which is beneficial to prevent the rotatable cover from rotating in the loosening direction. Since a self-locking force is generated to make the swing arm tooth close to the gap upward, the abutment between the tooth portion of the swing arm head and the second side wall of the gap constitutes reverse self-locking. The second side wall coincides with the radius or has an included angle within 10° with the radius, so even when the rotatable cover is rotated in the tensioning direction, the second side wall will reversely apply the upward resistance to the tooth portion of the swing arm, but the resistance is very small, which is not enough to hinder the sliding of the tooth portion along the first side wall of the gap. The tooth portion can still be disengaged from the gap, and the rotatable cover can still rotate smoothly in the tensioning direction.

Preferably, a straight line where the first side wall of the gap extends along and a radius through the first end point of the circumference of the end point of the gap may have an included angle in a range of 45°-80°. The first side wall is located on the second side of the radius corresponding to the first end point on the circumference of the gap.

For the asymmetric gap, the first side wall and the radius corresponding to the first end point is at a large acute angle, and the radial component force of the biasing force applied by the first side wall to the tooth portion of the swing arm head will be relatively large. The radial component force is transmitted to the elastic member along the swing arm, the elastic member deforms and drives the swing arm to move radially inward, and the circumferential component force perpendicular to the radial component force causes the swing arm to be deviated to the second side. Therefore, the tooth portion of the swing arm head will slide from an engaging position to a disengaging position along the first side wall of the gap, and the gap can rotate smoothly, such that the rotatable cover and the spool can tension the lace in the tensioning direction. In addition, the second side wall is arranged in parallel with the radius corresponding to the second end point, such that the force applied the second side wall to the second tooth wall of the tooth portion has basically no radial component force, and the swing arm cannot radially inward slide to give way. In addition, since the wedge-shaped head of the stop piece prevents the swing arm head from deviating towards widely to the first side, and the base portion of the stop piece prevents the swing arm beam from deviating towards the first side, the swing arm cannot be subjected to lateral deviation to give way, causing the tooth portion of the swing arm head to always remain engaged with the gap of the rotatable cover, and the rotatable and the spool cannot rotate in the loosening direction.

The design of the inclination of the tooth wall of the tooth portion of the swing arm head, especially the design of the inclination angle of the second tooth wall, makes the engagement between the tooth portion and the gap form reverse self-locking under the action of the external force in the loosening direction. According to the foregoing content, the abutment between the neck portion of the swing arm head and the wedge-shaped head of the stop piece also forms reverse self-locking under the action of the external force in the loosening direction. In this way, under the action of the external force in the loosening direction, the tooth portion of the swing arm head and the gap, and the neck portion and the wedge-shaped head of the stop piece form double reverse self-locking, which greatly enhances the anti-reverse function of the lacing device. In addition, with the limiting deviation function of the base portion of the stop piece on the swing arm beam, three effects are integrated, so even in the case of strong deformation ability of the elastic member, a single stop piece can achieve an effective anti-reverse function. The anti-reverse effect is not only superior to the conventionally designed swing arm-single stop piece mechanism, but also superior to the conventionally designed swing arm-double stop piece mechanism. The innovative design of the swing arm head and the wedge-shaped head of the stop piece in the present disclosure uses the double self-locking function ingeniously, which not only saves the structural space, but also improves the anti-reverse effect, and solves the problem of poor anti-reverse effect caused by the elastic member. With the novel design of the swing arm head and the wedge-shaped head of the stop piece and the excellent deformation ability of the elastic member, the lacing device not only has labor-saving operation and excellent hand feeling when tensioning the lace, but also has a quite reliable anti-reverse effect.

In the present disclosure, the reverse self-locking effect formed by the neck portion of the swing arm head and the wedge-shaped head of the stop piece is far stronger than the reverse self-locking effect formed by the engagement between the tooth portion and the gap under the action of the external force in the loosening direction. The reverse self-locking formed between the neck portion of the swing arm head and the wedge-shaped head of the stop piece is the main anti-reverse mechanism of the swing arm-stop piece-gap mechanism.

Preferably, the elastic member may be an elastic base or an elastic ring base composed of an elastic base.

The "swing arm elastic component" mentioned in the present disclosure mainly includes two forms: a retractable swing arm and a retractable swing arm ring, which will be introduced respectively below.

Preferably, the swing arm elastic component may be one or more retractable swing arms or a retractable swing arm ring. The retractable swing arm includes an elastic base and a swing arm connected thereto. The retractable swing arm ring includes an elastic ring base and a plurality of swing arms connected thereto. The retractable swing arm ring may be formed by connecting a plurality of retractable swing arms end to end through their elastic bases.

Preferably, the elastic base may be two serpentine elastic elements that are connected.

Preferably, the elastic base may be integrally formed.

Preferably, the elastic base and the swing arm may be arranged in one-to-one correspondence, and the two serpentine elastic elements in the elastic base may be arranged in mirror symmetry relative to the swing arm beam of the swing arm.

Preferably, the elastic base and the corresponding swing arm may be integrally formed.

Preferably, a main elastic force direction of the two serpentine elastic elements may be in the radial direction of the circumference of the swing arm. The main elastic direction refers to the direction with strong elastic deformation ability, and the direction perpendicular to it also has certain deformation performance, but the deformation ability is weak or the external force threshold for deformation is relatively large.

Preferably, a tail of each of the two serpentine elastic elements may be connected to the swing arm beam. An end of the swing arm beam connected to the serpentine elastic element is called the "swing arm tail". A tail end of the swing arm tail is the tail end of the free end of the swing arm beam.

Preferably, the connection point between the swing arm tail and the elastic base may be in a trident shape or similar to an inverted Y-shaped structure.

Preferably, the two serpentine elastic elements may be connected tail to tail.

Preferably, a tail-to-tail connection area of the two serpentine elastic elements may be configured as a waveform structure of an elastic portion that projects radially outward.

Preferably, the swing arm tail may be arranged at a peak position of the waveform structure of the elastic portion. The waveform structure that projects radially outward is similar to a peak position of a wave spring.

When the wave spring is subjected to an axial load, the wave peak and the wave trough generate axial relative displacement to form deformation energy. After the external load is removed, under the action of deformation energy, the original shape is restored, thus playing the role of buffering, shock absorption and compensation. The wave spring is mainly used in occasions where deformation and axial space requirements are very small and the vibration is reduced. The load-deformation characteristics of the wave spring are greatly affected by the spread angle, which is manifested in the rapid intervention in deformation of both ends of the wave spring after being compressed at a large spread angle, resulting in a rapid rise of a load-deformation characteristic curve. The spread angle, also known as the unfolding angle, in the present disclosure, refers to an angle at which two lines diverge at the position of a wave peak or a wave trough in a sine curve.

Preferably, the spread angle of the waveform structure of the elastic portion may be 110°-160°.

Preferably, heads of the two serpentine elastic elements may be relatively far apart.

Preferably, the heads of the two serpentine elastic elements may be separately fixed on the housing.

Preferably, the elastic base may include a first serpentine elastic element and a second serpentine elastic element that are connected in parallel, and the first serpentine elastic element and the second serpentine elastic element may be respectively arranged on both sides of the swing arm beam.

Preferably, a plurality of the elastic bases may be connected to form an elastic ring base, and the elastic ring base may be integrally formed.

One of a head of the first serpentine elastic element and a head of the second serpentine elastic element is defined as a head of each elastic base, and the other is defined as a tail of each elastic base. For example, the head of the first serpentine elastic element is defined as the head of each elastic base, then the head of the second serpentine elastic element is defined as the tail of each elastic base; and vice versa.

More preferably, any two adjacent elastic bases may be connected end to end.

Preferably, any two adjacent elastic bases may be connected end to end to form an elastic ring base of a closed-loop structure.

Further, an area where any two adjacent elastic bases are connected end to end is configured as a waveform structure of the fixing portion that protrudes radially outward.

Preferably, the waveform structure of the fixing portion may be provided with a fixing portion, and the elastic ring base may be fixedly arranged on the housing through the fixing portion.

Preferably, wave peaks of the waveform structures of the elastic portion in the elastic ring base may be located on the same circumference.

Preferably, wave peaks of the waveform structures of the fixing portion in the elastic ring base may be located on the same circumference.

When the rotatable cover is subjected to the external force in the tensioning direction, the side wall of the gap of the rotatable cover exerts bias pressure on the tooth portion of the swing arm head. The biasing force includes a radially inward component force. The biasing force is transmitted to the waveform structure of the elastic portion through the swing arm tail. Under the action of the radially inward component force, the waveform structure of the elastic portion deforms radially inward to drive the swing arm tail to move radially inward. In this process, the radially inward component force is also transmitted to elastic pieces of the two serpentine elastic elements through the waveform structure of the elastic portion. Under the action of the external force, the serpentine elastic element deforms and elongates in the radial direction. Since the elastic piece of the serpentine elastic element and the waveform structure of the elastic portion are an integrated structure, the deformation and elongation of the serpentine elastic element further strengthens the deformation ability of the waveform structure of the elastic portion and increase the amplitude of its radial displacement.

The external force applied by the side wall of the gap to the swing arm is quickly transmitted to the elastic member, and the elastic member converts the external force through contraction or tensile deformation, such that the swing arm is subjected to radial displacement, and there is basically no residual stress in the interior of the swing arm and the interior of the elastic member, which has excellent use reliability and durability. Moreover, the deformation of the elastic member drives the radial displacement of the swing arm, such that the swing arm head gives away more effortlessly and smoothly, thereby effectively improving the use of feeling of the lacing device when tensioning the lace.

The radially outward extension of the swing arm beam along the circumference of the one or more swing arms is defined as: the orthographic symmetry axis of the swing arm beam extends in the radial direction of the circumference of the one or more swing arms.

The orthographic projection refers to a projection obtained by projecting on the gap or the swing arm with a parallel projection line perpendicular to the projection plane, taking a circumferential surface parallel to the gap or the swing arm as a projection plane.

Preferably, an annular platform may be arranged on one end face of the housing, and the tails of the one or more swing arms may be connected to the annular platform through the elastic member. The annular platform is configured to support the one or more swing arms.

Preferably, the elastic member may be fixedly arranged on the annular platform.

Preferably, the manner in which the elastic member is fixed on the annular platform may include detachable and non-detachable fixing.

Preferably, the elastic member may be detachably fixed on the annular platform through a snap structure.

Preferably, the housing may be provided with a retractable swing arm ring. The retractable swing arm ring may include a retractable elastic ring base and one or more swing arms arranged along a circumference. The swing arm may include at least a swing arm head and a swing arm beam. The swing arm beam may extend outward in a radial direction of the circumference. The swing arm may be connected to the housing through the elastic ring base.

Preferably, the retractable elastic ring base and the one or more swing arms may be integrally formed to form the retractable swing arm ring.

Preferably, the retractable elastic ring base may be formed by connecting a plurality of the retractable swing arms end to end through the elastic base.

Preferably, the elastic ring base may include an outer ring portion and an inner ring portion, and the one or more swing arms may be arranged on the inner ring portion.

Preferably, the one or more swing arms may extend radially outward along the circumference of the inner ring portion of the elastic ring base.

Preferably, the elastic ring base may be fixedly arranged on the annular platform through a snap structure. The one or more swing arms may be supported on the end face of the annular platform.

Preferably, the stop piece and the annular platform may be integrally formed.

Preferably, the tooth portion of the swing arm head may extend out of an outer periphery of the annular platform. The tooth portion extends out of the outer periphery of the annular platform in order to be able to be inserted into the gap of the rotatable cover, so as to realize the engagement of the swing arm head with the gap.

Preferably, a leading edge of the wedge-shaped head of the one or more stop pieces may be substantially flush with the outer periphery of the annular platform. The expression "substantially flush" means that a distance between the leading edge of the wedge-shaped head and the outer periphery of the annular platform is within a range of ±1 mm.

Preferably, the rotatable cover may have a cavity with a buckle position, and the cavity may at least be provided with the gap.

Preferably, the gaps may be a circumferential gap or a segmented gap.

Preferably, the gap and the swing arm may be engaged and separated in the axial direction through a gear structure. The engagement or separation of the gap and the swing arm head in the radial direction is realized by the deviation displacement of the swing arm. The engagement and separation of the gap and the swing arm in the axial direction is a basis for the engagement and separation of the gap and the swing arm in the radial direction. The axial engagement means that the gap and the swing arm are co-located on the same plane. In the present disclosure, when the gap is axially engaged with the swing arm, the circumference of the swing arm is concentric with the circumference of the gap. A gear structure can provide at least two gears. For example, pressing down the rotatable cover generates a first gear, and the gap is engaged with the tooth portion of the swing arm head. Pulling up the rotatable cover generates a second gear, and the gap is axially separated from the tooth portion of the swing arm head.

Specifically, when the rotatable cover is pressed down, the rotatable cover is matched and connected with the spool, the gap of the rotatable cover is engaged with the tooth portion of the swing arm head of the housing, and the lacing system is in the first gear state at this time. When the rotatable cover is rotated in the tensioning direction, the lace is wound on the spool in the tensioning direction. In this gear state, the tooth portion of the swing arm head can only move in one direction due to the restraint of the stop piece, and the rotatable cover cannot be reversed, so as to realize the function of tensioning the lace and preventing loosening.

When the rotatable cover is pulled up, the rotatable cover is disengaged from the spool, the swing arm head is axially separated from the gap, the two are no longer coplanar, and the swing arm is no longer constrained by the stop piece. At this time, both the rotatable cover and the spool can rotate freely clockwise or counterclockwise, so as to automatically loosen the lace.

For preferred embodiments of a gear switching structure, a spool structure, and a connection method between the spool and the rotatable cover that are not mentioned in the present disclosure, reference may be made to the content of the patent document CN208993976U, the relevant content of which is incorporated herein by reference in its entirety. The rotatable cover in the present disclosure is equivalent to an upper cover in the patent CN208993976U, and the spool in the present disclosure is equivalent to a winder in the patent CN208993976U.

However, the spool structure and gear switching structure in the present disclosure are not limited to the structures disclosed in the patent document CN208993976U. A winding spool-gear structure component in the patent CN202121933315.3 is also applicable to the present disclosure, and other spool structures capable of realizing the gear switching function and the lacing take-up function are also applicable to the lacing device of the present disclosure.

Preferably, the housing may be directly fixed on an item to be laced. The items to be laced include shoes, clothes, hats, and bags.

Preferably, the lacing device may further include a base. The housing may be fixed on the base. The base may be fixed on the item to be laced.

Preferably, the spool may be integrally formed with the rotatable cover, or fixedly or detachably connected to the rotatable cover. When the spool is connected to the rotatable cover, the rotation of the rotatable cover will drive the spool to rotate.

The present disclosure provides a novel lacing device based on a swing arm-stop piece-gap anti-reverse mechanism. The swing arm and the stop piece are located on the housing. The gap is located on the rotatable cover. The rotatable cover is rotatable relative to the housing, that is, the gap is rotatable relative to the swing arm. However, the swing arm is also rotatable relative to the gap. In this case, it is only necessary to arrange the swing arm and the stop piece on the rotatable cover, and arrange the gap on the housing to realize the lacing function.

The present disclosure further provides a novel lacing device, including: a rotatable cover, a spool, and a housing. The rotatable cover is rotatably arranged on the housing, and the spool is supported by the housing, and is rotatable relative to the housing.

The housing is provided with one or more gaps.

The spool is configured to roll up a lace when rotating in a tensioning direction and release the lace when rotating in a loosening direction.

The rotatable cover is provided with a swing arm elastic component. The swing arm elastic component includes an elastic member and one or more swing arms arranged along a circumference. The swing arm is connected to the rotatable cover through the elastic member. The swing arm includes at least a swing arm head and a swing arm beam. The swing arm beam extends outward in a radial direction of the circumference of the one or more swing arms. The swing arm includes opposite first and second sides. The swing arm head is configured to engage the gap of the housing when the swing arm is in an original position. The swing arm beam and/or the swing arm head are/is configured to deviate from the original position towards the first or second side of the same swing arm.

The rotatable cover is further provided with one or more stop pieces, and the stop piece is located on the first side of the swing arm. The stop piece includes a wedge-shaped head, and the wedge-shaped head of the stop piece is arranged corresponding to the swing arm head.

When the rotatable cover is subjected to an external force in the tensioning direction, the stop piece and the elastic member allow relative displacement of the swing arm and the gap of the housing until the swing arm head is disengaged from the gap of the housing to allow the rotatable cover to rotate in the tensioning direction.

When the rotatable cover is subjected to an external force in the loosening direction, the external force in the loosening direction causes a side wall of the gap of the housing to exert bias pressure on the swing arm head to deviate the swing arm head, such that at least part of the swing arm head abuts against the wedge-shaped head of the stop piece, and the swing arm head always remains engaged with the gap of the housing to prevent the rotatable cover from rotating in the loosening direction.

In this solution, the bias of the side wall of the gap to the swing arm head when the external force in the loosening direction is applied is a reverse bias. The reason for the "reverse bias" is that the biasing force is derived from the resistance of the external force in the loosening direction, and the biasing force or its component force in a certain direction is opposite to the direction of the applied external force in the loosening direction. The forward bias or reverse bias is a type of bias, and the forward and reverse bias are simply distinguished according to the direction consistency of the biasing force and the external force.

When the rotatable cover is subjected to the external force in the loosening direction, the external force in the loosening direction causes the swing arm head to abut against the side wall of the gap of the housing, the abutting force causes the side wall of the gap to reversely exert bias pressure on the swing arm head, and the swing arm head is inclined under the action of the reverse biasing force, such that at least part of the swing arm head abuts against the wedge-shaped head of the stop piece, and then the wedge-shaped head applies an extrusion force to the swing arm head abutting against it. The extrusion force makes it difficult for the swing arm head to be further deviated and displaced, such that the swing arm head can always remain engaged with the gap of the housing to prevent the rotatable cover from rotating in the loosening direction.

Preferably, the stop piece may further include a base portion, and the base portion of the stop piece may be arranged corresponding to the swing arm beam.

Preferably, when the rotatable cover is subjected to the external force in the loosening direction, the external force in the loosening direction may cause the side wall of the gap to reversely exert bias pressure on the swing arm head to deviate the swing arm head, at least part of the swing arm head may abut against the wedge-shaped head of the stop piece, and the swing arm beam may abut against the base portion of the stop piece, such that the swing arm head may always remain engaged with the gap of the housing to prevent the rotatable cover from rotating in the loosening direction.

In the embodiment in which the swing arm rotates, a direction of the first side of the swing arm is the tensioning direction of the lacing device, and a direction of the second side opposite to the first side of the swing arm is the anti-reverse direction of the lacing device. The novel swing arm-stop piece-gap mechanism provided by the present disclosure is the anti-reverse mechanism. When the tooth portion of the swing arm is engaged with the gap, the anti-reverse mechanism only allows the lacing device to rotate in the tensioning direction, but cannot rotate in the loosening direction.

When the swing arm rotates, the swing arm acts as a driving part, and the gap has a blocking effect on the movement of the swing arm head. Therefore, when the rotatable cover is rotated in the tensioning direction, the swing arm head is subjected to the resistance of the gap on the housing, such that the swing arm head and/or the swing arm beam move to the second side of the swing arm to give way, and the rotatable cover and the spool can rotate in the tensioning direction. However, when the rotatable cover is rotated in the loosening direction, the biasing resistance applied by the side wall of the gap to the tooth portion of the swing arm head slightly deviates the swing arm head to the first side, such that at least part of the swing arm head abuts against the wedge-shaped head of the stop piece, and the base portion of the stop piece abuts against the swing arm beam at the same time to prevent the swing arm beam from deviating towards the first side to give way. Therefore, the tooth portion of the swing arm and the gap of the housing always remain engaged, and the rotatable cover cannot rotate in the loosening direction, thereby realizing the anti-reverse effect.

The present disclosure provides an anti-reverse mechanism for a lacing device, including:

one or more gaps arranged along a circumference;

a swing arm elastic component, including an elastic member and one or more swing arms arranged along a circumference, where the elastic member is connected to the swing arm; the swing arm includes at least a swing arm head and a swing arm beam, and the swing arm beam extends outward in a radial direction of the circumference of the one or more swing arms; and the swing arm includes opposite first and second sides, the swing arm head is configured to engage the gap when the swing arm is in an original position, and the swing arm beam and/or the swing arm head are/is configured to deviate from the original position towards the first or second side of the same swing arm; and one or more stop pieces, where the stop piece is located on the first side of the swing arm, and the stop piece and the swing arm are located on a same part and are arranged separately; and the stop piece includes a wedge-shaped head and a base portion, the wedge-shaped head of the stop piece is arranged corresponding to the swing arm head, and the base portion of the stop piece is arranged corresponding to the swing arm beam.

When the gap is subjected to an external force in the tensioning direction, the stop piece and the elastic member allow relative displacement of the swing arm and the gap until the swing arm head is disengaged from the gap to allow the gap to rotate in the tensioning direction.

When the gap is subjected to an external force in the loosening direction, the external force in the loosening direction causes a side wall of the gap to exert bias pressure on the swing arm head to deviate the swing arm head, such that at least part of the swing arm head abuts against the wedge-shaped head of the stop piece, and the swing arm head always remains engaged with the gap to prevent the gap from rotating in the loosening direction.

The direction of the first side of the swing arm is the anti-reverse direction of the mechanism, that is, the loosening direction of the lacing device. The direction of the second side of the swing arm is the tensioning direction of the lacing device.

When the stop piece and the swing arm are located on the same part, it can be ensured that the stop piece and the swing arm rotate with the part, and the stop piece and the swing arm can also be relatively stationary when the part is stationary (excluding the deviation movement of the swing arm).

Preferably, when the gap is subjected to the external force in the loosening direction, the external force in the loosening direction causes the side wall of the gap to exert bias pressure on the swing arm head to deviate the swing arm head, at least part of the swing arm head may abut against the wedge-shaped head of the stop piece, and the swing arm beam may abut against the base portion of the stop piece, such that the swing arm head may always remain engaged with the gap to prevent the gap from rotating in the loosening direction.

Preferably, the swing arm elastic component may be a retractable swing arm or a retractable swing arm ring.

Preferably, the stop piece and the swing arm may be arranged in one-to-one correspondence.

Preferably, the swing arm head may include a tooth portion and a neck portion.

Preferably, the swing arm head may include one or more tooth portions.

Preferably, the first side surface of the neck portion of the swing arm head may be arranged in parallel with the slope surface of the wedge-shaped head of the stop piece.

The beneficial effects of the present disclosure include the following aspects:

1. The novel anti-reverse mechanism based on swing arm-stop piece-gap is provided, and is applied to the lacing device, which enriches the types of lacing devices and increases the variety of user choices.

2. The ingenious design and cooperation of the wedge-shaped head of the stop piece and the swing arm neck make the rotatable cover form reverse self-locking under the action of the external force in the loosening direction, which further enhances the anti-reverse performance of the anti-reverse mechanism.

3. The self-locking between the wedge-shaped head of the stop piece and the swing arm neck and the self-locking between the swing arm tooth and the second side wall of the gap constitute a double self-locking effect under the external force in the loosening direction. In addition, with the reverse limiting deviation of the base portion of the stop piece on the swing arm beam, three effects are integrated, which greatly enhances the anti-reverse performance of the lacing device. A single stop piece can achieve an anti-reverse effect superior than that of the structure with two stop pieces corresponding to one swing arm. The design is ingenious and the anti-reverse effect is remarkable.

4. The swing arm head is engaged with the gap in double teeth, and the anti-reverse effect of the mechanism is further enhanced.

5. With the deformation ability of the elastic member in the swing arm elastic component, the lacing device has labor-saving operation and excellent hand feeling when tensioning the lace. The novel structure design of the swing arm-stop piece makes up for the disadvantage of the elastic member with large elasticity in the anti-reverse performance, such that the lacing device has excellent anti-reverse performance. The lacing device using the novel anti-reverse mechanism not only has excellent hand feeling when the lace is tensioned, but also can effectively avoid the accidental loosening of the lace.

BRIEF DESCRIPTION OF THE DRAWINGS

FIG. 8A is a top view of different positions where the swing arm moves to give way when the lacing device shown in FIG. 1 applies the external force in the tensioning direction (a position where the tooth portion of the swing arm is re-engaged with the gap);

FIG. 10A is a schematic structural diagram of a swing arm and a gap in an original position in a comparative example of the embodiment shown in FIG. 1;

DETAILED DESCRIPTION OF THE EMBODIMENTS

Figure 1:
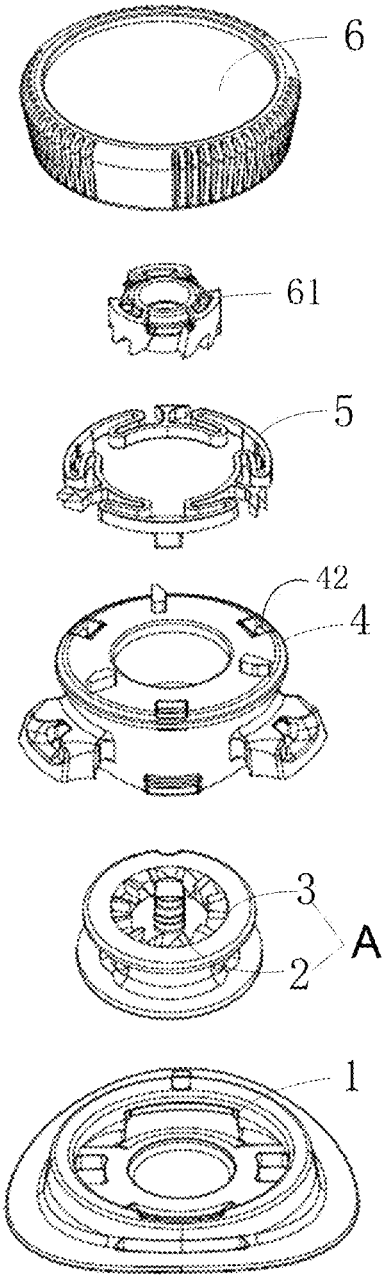
FIG. 1 is an explosion diagram of an embodiment of a lacing device based on a novel swing arm-stop piece-gap mechanism of the present disclosure.

The present disclosure will be further described below with reference to the accompanying drawings and embodiments, in which the same or similar reference numerals represent the same or similar components or components with the same or similar functions throughout. The embodiments described below with reference to the accompanying drawings are exemplary, and are only used to explain the present disclosure but should not be construed as a limitation to the present disclosure.

It should be understood that the terms "upper", "lower", "left", "right", "front", "rear", "length", "width", "horizontal", "vertical", "top", "bottom", "inside", and "outside" used in the expressions of the present disclosure to indicate an orientation or positional relationship are all based on the orientation or positional relationship shown in the accompanying drawings, which are intended to facilitate the description of the present disclosure and simplify the description, and cannot be understood as a limitation that the referred device or component must have a specific orientation or a specific positional relationship.

In addition, the terms "first" and "second" are only used for the purpose of discriminative description, and have no connotation of relative importance, nor do they indicate or imply the number of technical features. Thus, a feature defined with "first" or "second" may expressly or implicitly that there are one or more features including that feature. In the description of the present disclosure, "a plurality of" means two or more, unless otherwise specifically defined.

Unless otherwise specified, terms such as "connection" and "fixed" in the present disclosure should be understood in a broad sense, for example, it may be a fixed connection, a detachable connection, or an integral forming; it may be a direct connection, or an indirect connection through an intermediate medium. Those of ordinary skill in the art may understand specific meanings of the foregoing terms in the present disclosure based on a specific situation.

A novel unidirectional anti-reverse mechanism based on the swing arm-stop piece-gap and a novel lacing device including the same in the present disclosure will be described in detail below with reference to the accompanying drawings and specific embodiments.

Embodiment 1

As shown in 1, a novel lacing device includes a base 1, a spool component A, a housing 4, a retractable swing arm ring 5, and a rotatable cover 6. The base 1 may be fixedly arranged on the upper, tongue, clothes, hats, or bags. A top end face of the housing 4 is fixedly connected to the swing arm ring 5 through a snap structure 42. The spool component A includes an elastic stop pin 2 and a spool 3. For the structure of the spool component A and a connection method with the rotatable cover 6, reference may be made to the content of the patent document CN202121933315.3.

Figure 2:
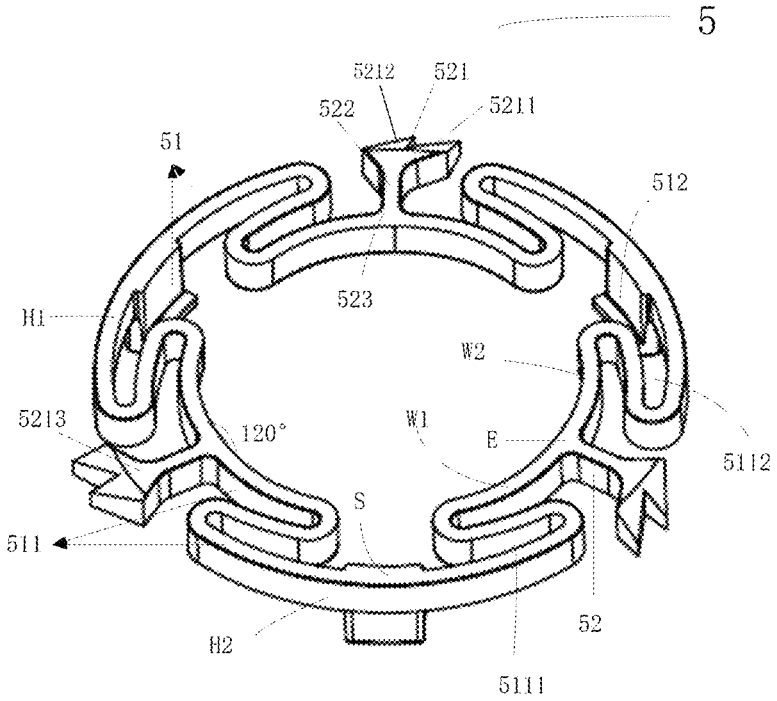
FIG. 2 is a schematic structural diagram of a retractable swing arm ring in FIG. 1.

As shown in FIG. 2, the retractable swing arm ring 5 includes a centrally arranged retractable elastic ring base 51 and one or more swing arms 52 arranged along a circumference. The swing arm 52 includes a swing arm head 521 and a swing arm beam 522. In the present embodiment, three swing arms are arranged, the three swing arms are arranged at equal intervals, and each swing arm beam 522 extends radially along the circumference of the elastic ring base. As shown in the figure, the swing arm head 521 includes two tooth portions 5211 and 5212 and a neck portion 5213, and the shape of each tooth portion 5211 and 5212 is the same as that of the gap on the rotatable cover (see 6511 and 6512 in FIG. 5B), which is angular, and the tooth portion can be engaged with or separated from the gap on the rotatable cover 6. The overall shape of the neck portion 5213 and the swing arm beam 522 is similar to the shape of an axe. The elastic ring base 51 includes three elastic bases 511. Each elastic base 511 is formed by connecting a first serpentine elastic element 5111 and a second serpentine elastic element 5112. The first serpentine elastic element 5111 and the second serpentine elastic element 5112 are arranged on both sides of each swing arm 52 respectively and in mirror symmetry relative to the swing arm beam 522. A main elastic force direction of the two serpentine elastic elements 5111 and 5112 are approximately in a radial direction of the circumference. Tails W1 and W2 of the two serpentine elastic elements 5111 and 5112 are connected to form a waveform structure of an elastic portion E that projects radially outward. The tail 523 of the swing arm 52 is arranged at a peak position of the waveform structure of the elastic portion E, and a connection position is similar to an inverted Y-shaped structure. The spread angle of the waveform structure of the elastic portion E is 120°. Heads H1 and H2 of the two serpentine elastic elements (which are also a head H1 and a tail H2 of the elastic base) are relatively far apart, and are separately fixed on the housing 4. Three elastic bases are connected end to end to form a retractable elastic ring base 51 of a closed-loop structure, and the elastic ring base 51 is integrally formed. An end-to-end connection area of the elastic bases protrudes radially outward to form a waveform structure of a fixing portion S. A snap structure 512 is arranged near the wave peak of the waveform structure of the fixing portion S. A corresponding snap groove 42 is arranged on the housing (see FIG. 3 for details) to fix the retractable elastic ring base 51 on the housing 4. Because the waveform structure of an elastic portion E protrudes radially outward, when the wave peak position of the waveform structure is subjected to radial inward pressure, its deformation ability is very strong.

Figure 3:
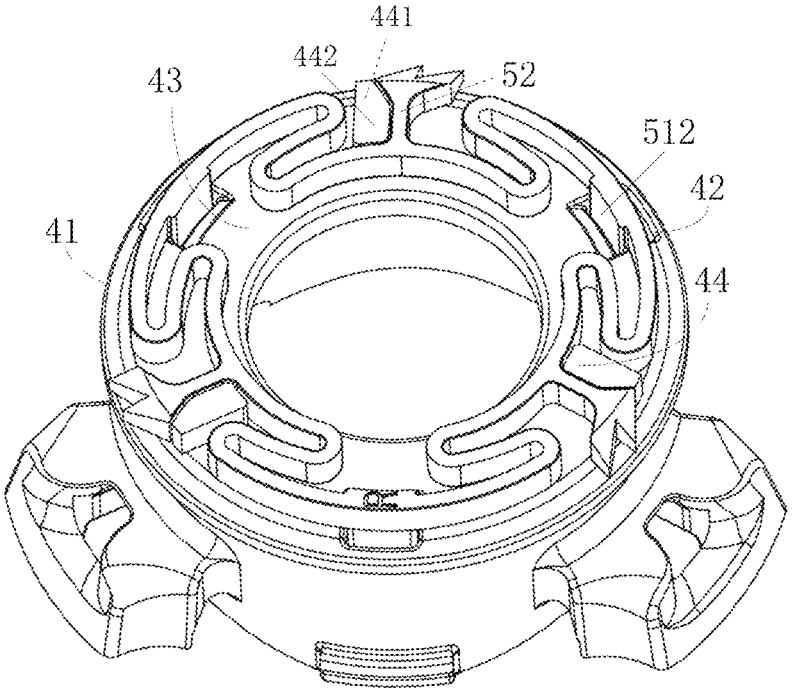
FIG. 3 is a schematic diagram of a combined structure of a housing and the retractable swing arm ring in the lacing device shown in FIG. 1.
Figure 4:
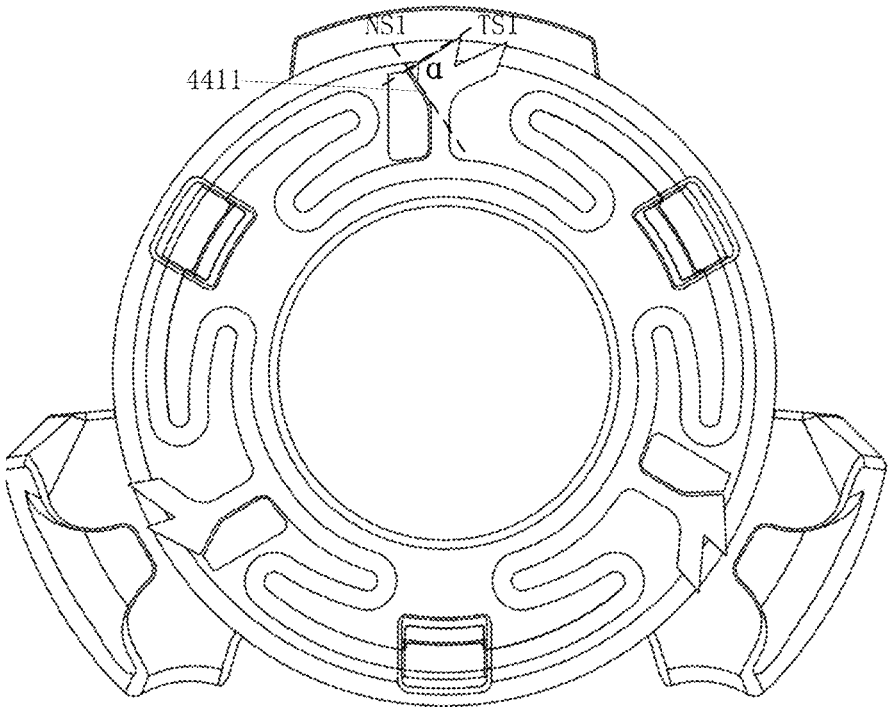
FIG. 4 is an orthographic view of the combined structure of the housing and the retractable swing arm ring in the lacing device shown in FIG. 1.

FIG. 3 is a schematic diagram of a combined structure of a housing and the retractable swing arm ring. As shown in FIG. 3, the housing 4 includes an annular platform 43. A center of the annular platform is a through hole for the elastic stop pin 2 to pass through, and engaging teeth of the end face of the spool 3 are exposed to be meshed with engaging teeth of the rotatable cover. The end face of the annular platform 43 is integrally formed with one or more stop pieces 44 near an outer periphery. The stop piece 44 and the swing arm 52 are arranged in one-to-one correspondence, and are arranged adjacent to the same side of the swing arm 52 (a clockwise side or a counterclockwise side, in the present embodiment, it is the counterclockwise side (also called a first side)). The stop piece 44 includes a wedge-shaped head 441 and a base portion 442. The wedge-shaped head 441 of the stop piece is arranged corresponding to the swing arm head 521. The base portion 442 of the stop piece is arranged corresponding to the swing arm beam 522. As shown in FIG. 4, a first tooth wall TS1 of each tooth portion is perpendicular to a first side surface NS1 of the neck portion)($\alpha$=90°, and a slope surface 4411 of the wedge-shaped head 441 of the stop piece is parallel to the first side surface NS1 of the neck portion. In other preferred embodiments, the included angle $\alpha$ between the first tooth wall TS1 of each tooth portion 5211 and the first side surface of the neck portion 5213 can also be set to other angles in a range of 60°-120°, as long as the first side surface NS1 is always located on the first side (counterclockwise side) in the radial direction of the swing arm and is inclined in the counterclockwise direction (which can be combined with the description of FIG. 5B). The stop piece 44 is configured to prevent the swing arm 52 from moving in the counterclockwise direction (the first side direction), thereby preventing the rotatable cover from rotating in the counterclockwise direction. The clockwise direction of the lacing device using the novel stop piece-retractable swing arm ring structure is the direction of tensioning the lace, such that the arrangement of the stop piece 44 can prevent the rotatable cover and the spool from rotating in the counterclockwise direction under the action of the external force in the loosening direction, thereby preventing the lace from being accidentally disengaged in the tensioning state. The housing 4 is also provided with a ring of buckle protrusions 41, an inner wall of a cavity of the corresponding rotatable cover 6 has at least one buckle position (hidden in the figure), and the rotatable cover 6 is pressed and buckled on the outer periphery of the housing to form a whole locking structure of the lacing device.

When the lacing device is assembled, the end face of the annular platform 43 of the housing 4 and the snap of the retractable swing arm ring 5 are fixed, and then the rotatable cover 6 is fixed with the engaging teeth and then pressed and buckled on the housing 4. Then, the spool component A is loaded into the housing 4 from the bottom of the housing 4 (the housing 4 has an inner cavity). One end of the elastic stop pin passes through a central through hole of the housing 4. Finally, the lace is threaded, and the housing 4 is fixed with the base 1, and the lacing device is assembled.

When the lacing device is in use, the rotatable cover 6 is pressed down hard, and a "click" sound can be heard, such that the engaging teeth 61 on the rotatable cover 6 is meshed with the engaging teeth on the spool 3, and the rotatable cover 6 can rotate to drive the spool 3 to rotate together at this time. The rotatable cover 6 is rotated in the tensioning direction, and a crisp "click" sound can be heard. At this time, the tooth portion 5211 of the swing arm head is engaged with the gap on the rotatable cover, and the engaging teeth on the rotatable cover and the end face of the spool are meshed. The rotatable cover 6 drives the spool 3 to rotate in the tensioning direction, and the lace is wound in the channel of the spool 3 round by round. The item to be laced is slowly tensioned by the lace until tightness is suitable. If the lace is too tight, the rotatable cover 6 can be pulled up, and the engaging teeth on the rotatable cover and the end face of the spool are disengaged. At this time, the tight lace will reverse the spool to loosen the item. Then the rotatable cover 6 is pressed down, the previous tensioning action is repeated, and the tightness of the item to be laced is adjusted to a suitable level.

Figure 5A:
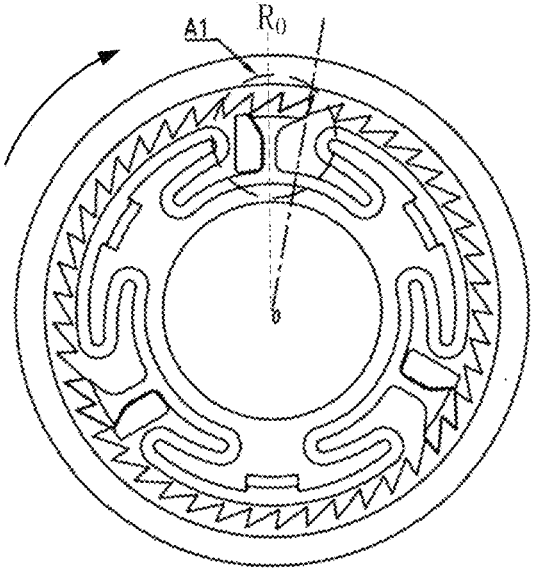
FIG. 5A is a top view of a process of a swing arm moving to give way when the lacing device shown in FIG. 1 applies an external force in a tensioning direction (a position where a tooth portion of the swing arm is engaged with a gap)
Figure 5B:
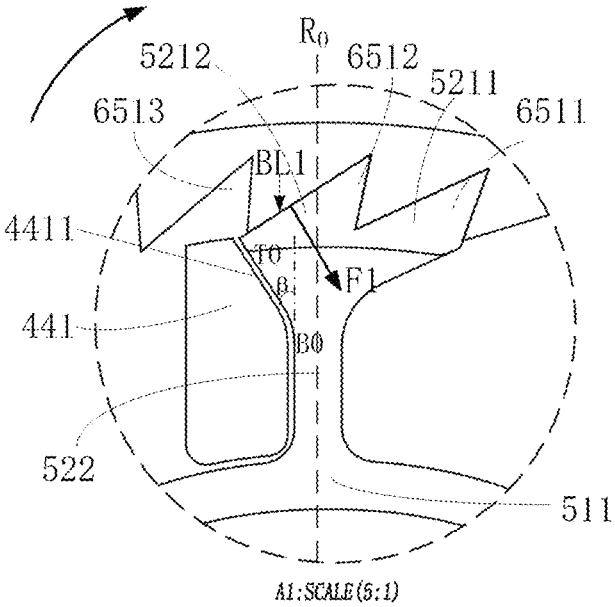
FIG. 5B is a partially enlarged view of a position A1 in FIG. 5A.
Figure 6A:
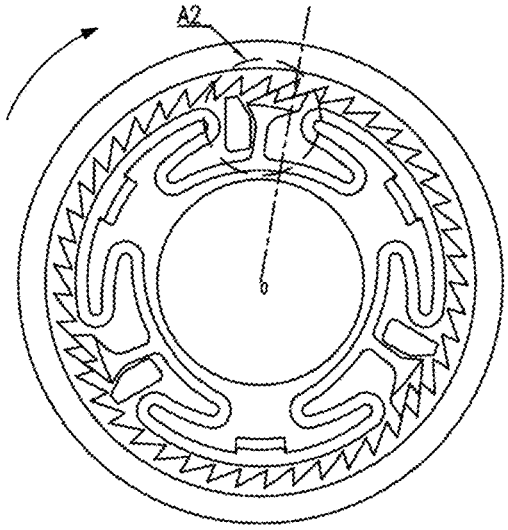
FIG. 6A is a top view of the process of the swing arm moving to give way when the lacing device shown in FIG. 1 applies the external force in the tensioning direction (a position in a middle process of the swing arm giving way)
Figure 6B:
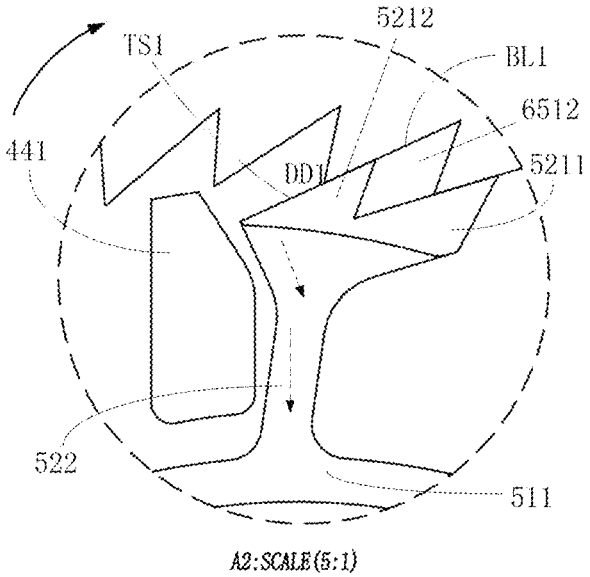
FIG. 6B is a partially enlarged view of a position A2 in FIG. 6A.
Figure 7A:
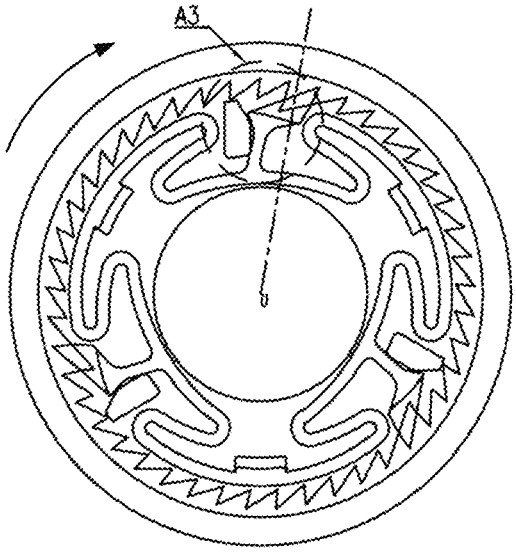
FIG. 7A is a top view of the process of the swing arm moving to give way when the lacing device shown in FIG. 1 applies the external force in the tensioning direction (a critical position of the swing arm to give way)
Figure 7B:
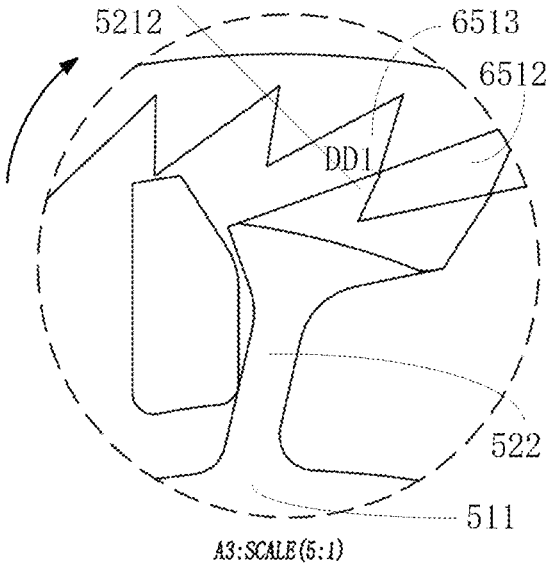
FIG. 7B is a partially enlarged view of a position A3 in FIG. 7A.
Figure 8B:
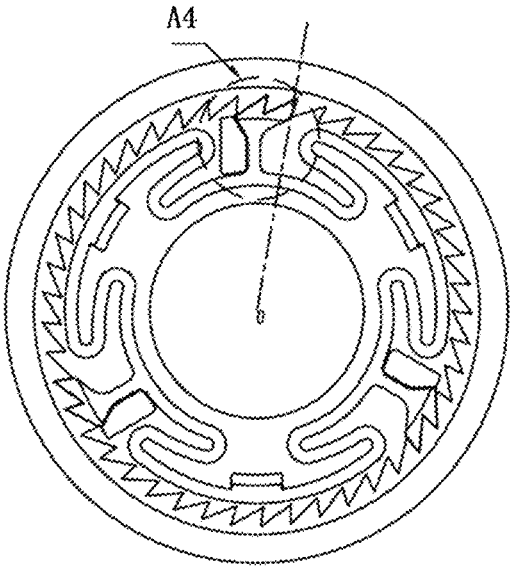
FIG. 8B illustrates a partially enlarged view of a position A4 in FIG. 8A.
Figure 8B:
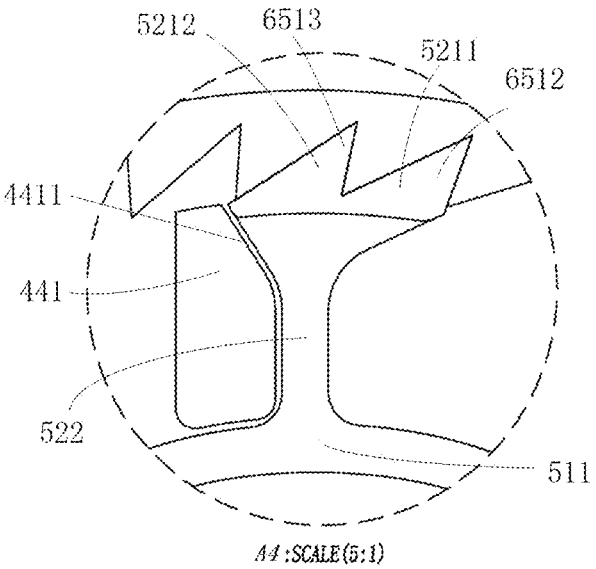

With reference to FIG. 5A to FIG. 8B, in the present embodiment, when the rotatable cover is rotated in the tensioning direction (clockwise direction), the swing arm moves to give way in the following process: as shown in FIG. 5B, at a position A1, the tooth portions 5211 and 5212 of the swing arm are engaged with the gaps 6511 and 6512 of the rotatable cover, as shown in FIG. 5A and FIG. 5B, teeth are provided along a circumference of the rotatable cover, the gaps 6511 and 6512 are formed by the space between adjacent teeth, and the swing arm is in a state of natural extension. At this time, the radial direction of the swing arm is $R_0$ (in the present embodiment, the $R_0$ direction is set as a vertical direction). The first side surface of the swing arm neck is located on a first side of the radial direction $R_0$ of the swing arm, and its top T0 is inclined to the first side of the swing arm compared to its bottom B0. The first side surface and the radial direction $R_0$ of the swing arm has an included angle $\beta=30°$. In other embodiments, the included angle $\theta$ may be other acute angles. When the rotatable cover is rotated in the clockwise direction, the gap is subjected to a clockwise rotating force. Taking one tooth portion-gap pair as an example, a first side wall BL1 of the gap 6512 extrudes the tooth portion 5212 of the swing arm, forcing the swing arm head and the swing arm beam 522 to be deviated to give way in the direction of an extrusion force F1. The extrusion force F1 is perpendicular to the side wall BL1, and is also parallel to the slope surface 4411 of the wedge-shaped head 441 of the stop piece. Therefore, under the action of the extrusion force F1, the moving tendency of the swing arm head is parallel or nearly parallel to the slope surface 4411 of the wedge-shaped head of the stop piece. Therefore, the wedge-shaped head of the stop piece will not hinder the displacement of the swing arm head in this direction, and at the same time, part of the extrusion force applied by the side wall BL1 of the gap 6512 to the swing arm tooth 5212 is transmitted to the elastic base 511 connected therewith along the swing arm beam 522 and forces the elastic base 511 to elastically deform, so as to further drive the swing arm beam to move radially inward. Thus, the first side wall TS1 of the tooth portion 5212 of the swing arm can slide in the direction of A1 to A2 along the first side wall BL1 of the gap 6512. The rotating force is continuously applied, the tooth portion 5212 of the swing arm slides to a first end point DD1 of the gap along the first side wall BL1 of the gap, and at this time, the swing arm is inclined to give away to the maximum extent and reaches a critical position A3, which is unstable. Under the restoring elastic force of the swing arm and the elastic base 511, the tooth portion 5212 of the swing arm is quickly engaged with the next gap 6513, and reaches a position A4 for re-engagement. At this time, the gap is advanced one step in the clockwise direction. The previous tensioning action is repeated to realize the rotation of the rotatable cover and the spool round and round.

Figure 9A:
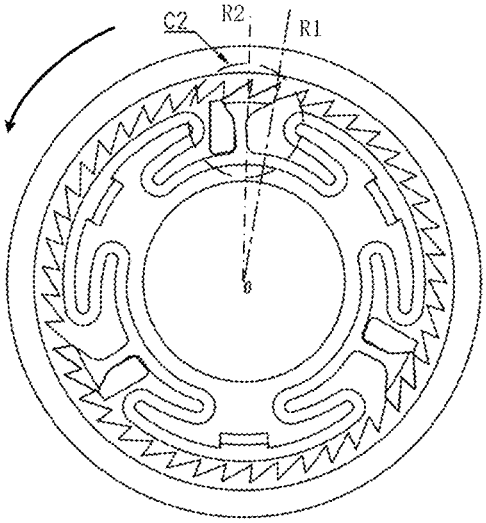
FIG. 9A is a top view of the swing arm-stop piece-gap mechanism when the lacing device shown in FIG. 1 applies an external force in a loosening direction.
Figure 9B:
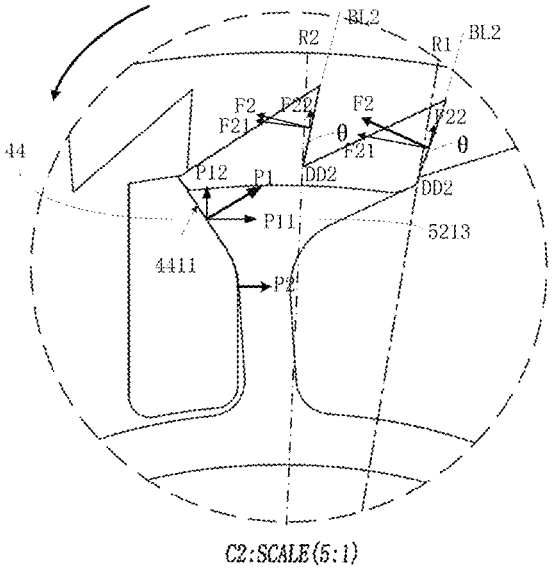
FIG. 9B is a partially enlarged view and a force analysis diagram of a position C2 in FIG. 9A.

In combination with FIG. 9A and FIG. 9B, in the present embodiment, a second side wall BL2 of the gap exerts bias pressure on the swing arm tooth when the rotatable cover is rotated in the loosening direction (counterclockwise direction). As shown in the figure, the two tooth portions of the swing arm are separately subjected to a biasing force F2. The biasing force F2 includes a counterclockwise circumferential component force F21 and an upward radial component force F22. Under the action of the circumferential component force F21, the swing arm head is inclined in the counterclockwise direction, such that the first side surface NS1 of the neck portion 5213 of the swing arm abuts against the slope surface 4411 of the wedge-shaped head of the stop piece, the swing arm beam partially abuts against the base portion of the stop piece, the slope surface 4411 applies an oblique upward extrusion force P1 to the neck portion 5212, and the base portion of the stop piece applies a transverse extrusion force P2 to the swing arm beam. The extrusion force P1 is in a direction basically the same as that of the first side wall of the swing arm tooth, and has an upward radial component force P12 and a circumferential component force P11. The circumferential component force P11 can partially deviate the circumferential component force of the biasing force F2. A combined force of the extrusion force P1 and the biasing force F2 makes the swing arm tooth push up against the gap of the rotatable cover, that is, the extrusion force applied by the stop piece to the swing arm forms a first self-locking force for engagement of the swing arm tooth with the gap of the rotatable cover. At the same time, the extrusion force P2 applied by the base portion of the stop piece to the swing arm beam is basically a circumferential force, which can restrict the swing arm from swinging to the side in the counterclockwise direction. The radial direction of the radial component force of the biasing force F2 received by each tooth portion corresponds to a radial direction R1 or R2 where a second end point DD2 of each tooth portion is located separately. The radial direction of the radial component force of the extrusion force P1 applied by the slope surface 4411 to the neck portion 5212 refers to the $R_0$ direction in FIG. 5B. In the description of the present embodiment, the same structure is marked with the same reference numeral. If there is no corresponding reference numeral in a single figure, reference may be made to the figure with the corresponding structure reference numeral.

On the other hand, a straight line BL2 of the second side walls of any two adjacent gaps and radii R1/R2 corresponding to their respective second end points DD2 have an included angle $\theta=10°$ separately. Therefore, the biasing force F2 applied by the second side wall BL2 of the gap to the swing arm tooth will have an upward radial component force F22 in the direction of the radius R1 or R2 where the second end point DD2 is located. The upward radial component force also makes the swing arm tooth push against the side wall of the gap to form a second self-locking force for engagement of the swing arm tooth with the gap of the rotatable cover. In this way, the double self-locking forces and the reverse swing limit are integrated, which greatly enhances the anti-reverse performance of the lacing device. A single stop piece can achieve an anti-reverse effect superior than that of the structure with two stop pieces corresponding to one swing arm. The design is ingenious and the anti-reverse effect is remarkable.

Figure 10B:
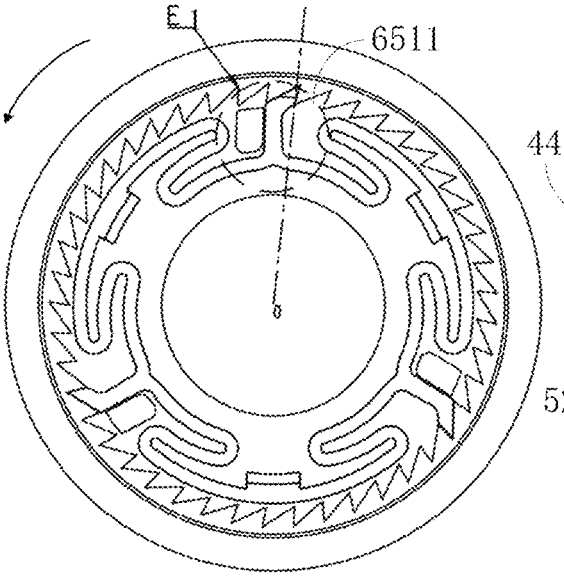
FIG. 10B is a partially enlarged view of a position E in FIG. 10A.
Figure 10B:
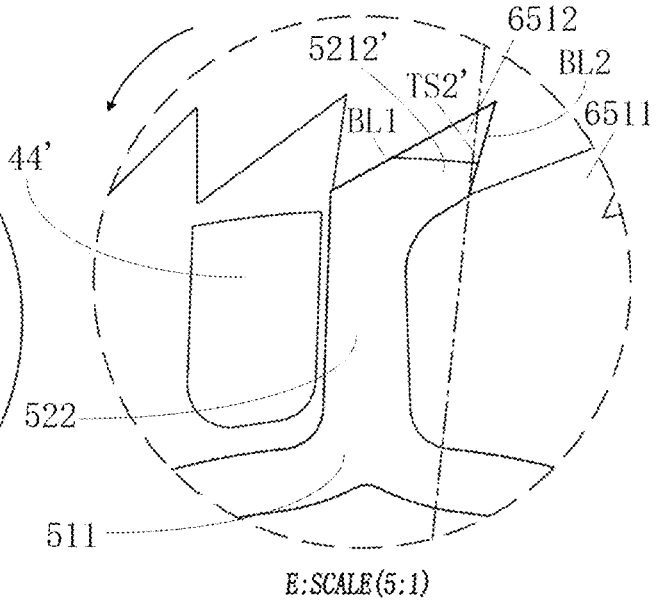

In the comparative example of the swing arm-stop piece-gap mechanism shown in FIG. 10A and FIG. 10B, the structures of the gap and the elastic base are exactly the same, and thus are marked with the same reference numerals. The difference lies in the structural design of the swing arm and the stop piece. More specifically, as shown in FIG. 10B, in this comparative example, the swing arm head only includes a tooth portion without a neck portion, and includes only one tooth portion 5212'. The structure of a single tooth portion is the same as that of Embodiment 1, and the stop piece 44' is not provided with a wedge-shaped head. Only the base portion is arranged adjacent to the swing arm beam 522, and the structure of the swing arm beam 522 is the same as that of Embodiment 1.

Figure 11A:
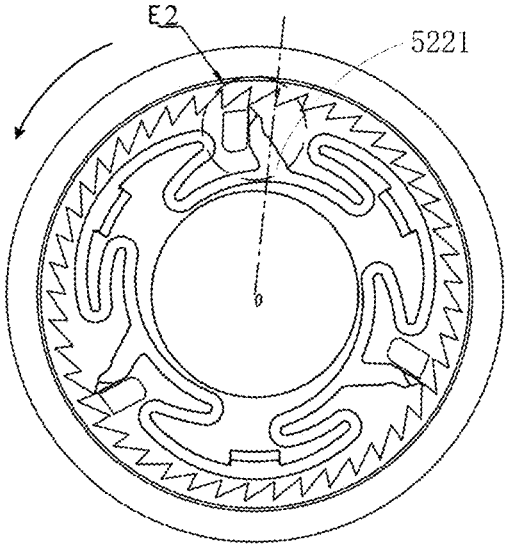
FIG. 11A is a schematic diagram of anti-reverse failure of a swing arm-stop piece mechanism in the comparative example shown in FIG. 10*a;*
Figure 11B:
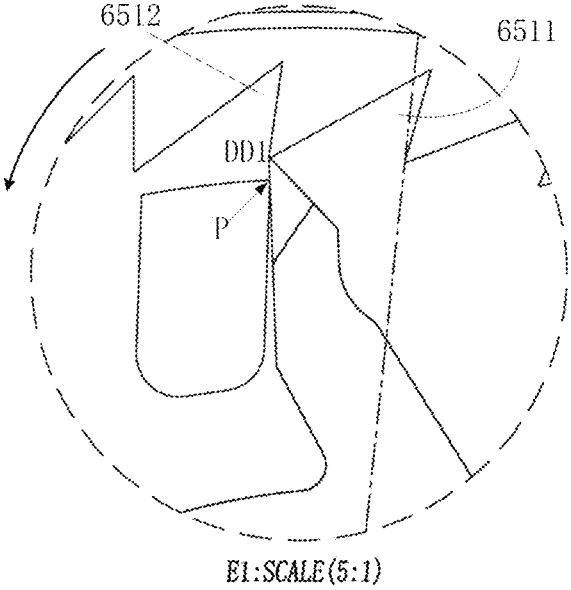
FIG. 11B is a partially enlarged view of a position E2 in FIG. 11A.

When the rotatable cover is rotated in counterclockwise direction, the second side wall BL2 of the gap 6512 applies an extrusion force to the second tooth wall TS2' of the swing arm tooth 5212'. Although the extrusion force has a radially outward component force, this component force is very small, most of which are circumferential component forces. When the applied external force in the loosening direction is small, the swing arm cannot move away from the gap due to the obstruction of the stop piece 44', so the rotatable cover cannot rotate in the clockwise direction. With reference to FIG. 11B, after the applied external force in the loosening direction exceeds a certain threshold, the circumferential component force of the external force in the loosening direction forces the swing arm to be deviation. At this time, the swing arm abuts against the stop piece. A contact point of the stop piece and the swing arm constitutes a fulcrum P of the lever, which further increases the external force in the loosening direction. The first side wall BL1 of the gap will also apply a certain extrusion force to the swing arm tooth, and the extrusion force has a radially inward component force. With the continuous increase of the external force in the loosening direction, the radially inward component force of the extrusion force is transmitted to the elastic base 511. Due to the strong deformation ability of the elastic base, elastic deformation will occur even when the radially inward force is small. Therefore, the contact between the swing arm tooth and the second side wall of the gap gradually changes into a point contact, and the extrusion force applied by the gap of the rotatable cover to the swing arm tooth is equivalent to the external pressure on one end of the lever. According to the lever principle, under the action of the force and the characteristics of easy deformation of the elastic base, the tail 5221 of the swing arm will tilt up. With the increase of the tilt degree of the tail 5221, the hindering effect of the stop piece on the swing arm gradually decreases. The swing arm tooth is gradually disengaged from the gap until a critical position shown in FIG. 11B, and only the apex of the tooth portion 5212' is in contact with the first end point DD1 of the gap 6512. In this process, the position of the contact point P between the stop piece and the swing arm (equivalent to the fulcrum of a lever) on the swing arm may change continuously with the deviation displacement of the swing arm. Since the critical position is unstable, under the restoring elastic force of the swing arm and the elastic base 511, the tooth portion 5212' of the swing arm is quickly engaged with the next gap 6511 to achieve re-engagement. At this time, the gap is advanced one step in the counterclockwise direction. By continuously applying a large external force in the loosening direction, the rotatable cover and the spool can rotate in the counterclockwise direction round and round. The lacing device loses its anti-reverse function. Therefore, in the comparative example, the structural arrangement of the stop piece and the swing arm head cannot prevent the accidental loosening of the lace under a large external force in the loosening direction (an external force in the loosening direction exceeding a certain threshold), because when the external force in the loosening direction exceeds a certain threshold, the swing arm-stop piece-gap mechanism loses the anti-reverse function. Therefore, in special situations outdoors, the external force in the loosening direction is unexpectedly increased, and the lace is at risk of loosening. Therefore, although the characteristics of easy deformation of the elastic base 511 have an excellent effect on the improvement of the hand feeling when tensioning the lace, the corresponding risk of lace loosening also increases. The swing arm-stop piece-gap mechanism used by the comparative example only has the upward self-locking effect of the swing arm tooth and the gap and the anti-deflection effect of the base portion of the stop piece. This double effect can only be used for a small external force in the loosening direction. When the external force in the loosening direction exceeds a certain threshold, the anti-reverse effect is lost, so a lacing device using this mechanism can only have the effect of preventing the lacing from loosening for a small external force in the loosening direction.

Figure 12A:
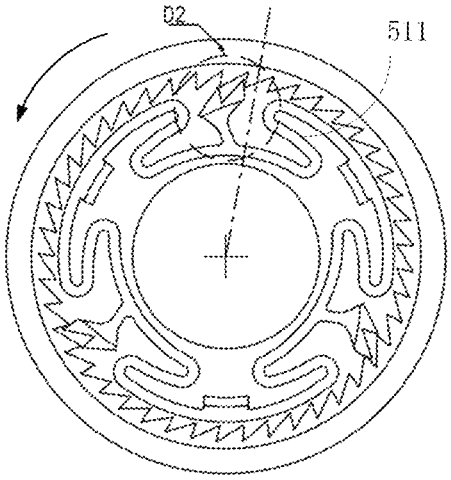
FIG. 12A is a top view of a middle position where the swing arm moves in an opposite direction to give way after removing a stop piece in the embodiment shown in FIG. 1.
Figure 12B:
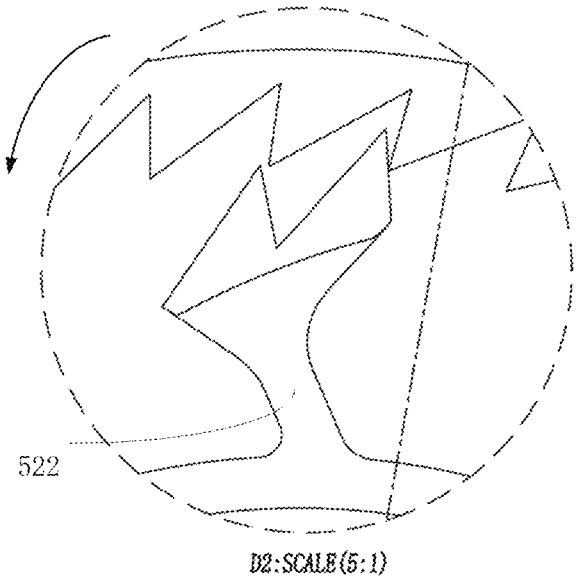
FIG. 12B is a partially enlarged view of a position D2 in FIG. 12A.

FIG. 12A and FIG. 12B are a top view and a partially enlarged view of a middle position D2 where the swing arm moves in an opposite direction to give way after removing a stop piece in the embodiment shown in FIG. 1. It can be seen from FIG. 5A to FIG. 8B, FIG. 12A, and FIG. 12B that the swing arm structure provided by the present disclosure can move to give way bidirectionally without a stop piece, and the deviation of the swing arm to both sides is not only the deviation of the swing arm beam 522 itself. The elastic deformation of the elastic base 511 also plays an important role. The excellent deformation ability of the elastic base 511 reduces the difficulty of the deviation of the swing arm and is conducive to improving the hand feeling of the user. The movement and displacement of the swing arm not only is the deviation of the swing arm to both sides, but also includes the radially inward movement and displacement of the swing arm. The realization mechanism of the radially inward movement of the swing arm depends on the elasticity of the elastic base. In the present embodiment, the elastic base can not only extend and retract in the radial direction, but also locally twist in the circumferential direction, so as to drive the swing arm to move radially inward and to be deviated to both sides at the same time.

Figure 13:
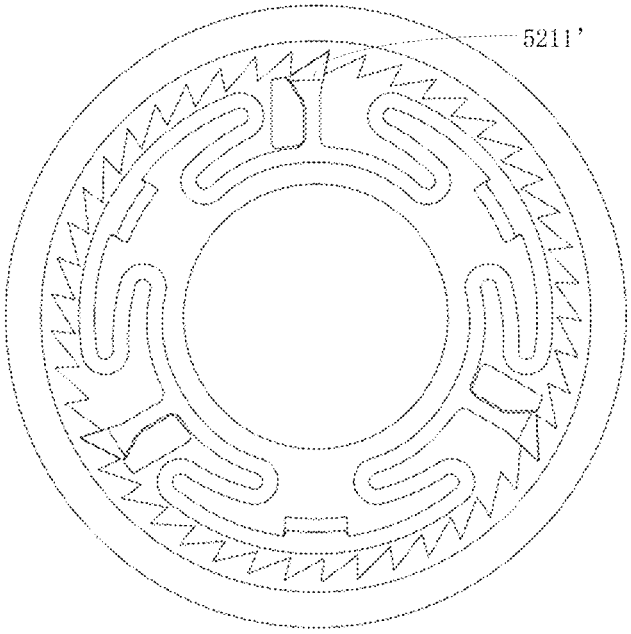
FIG. 13 is a schematic diagram of another embodiment of the swing arm in the lacing device.

In other preferred embodiments, the swing arm head may only include one tooth portion 5211', as shown in FIG. 13. Compared with the swing arm head with two tooth portions, the anti-reverse effect of the two tooth portions is more excellent.

In other preferred embodiments, the counterclockwise direction can also be set as the direction of tensioning the lace, and the clockwise direction can be set as the direction of loosening the lacing. At this time, the stop piece should prevent the swing arm from swinging in the clockwise direction. Therefore, it is necessary to reasonably arrange the arrangement position of the stop piece according to the actual situation.

Embodiment 2

Figure 14A:
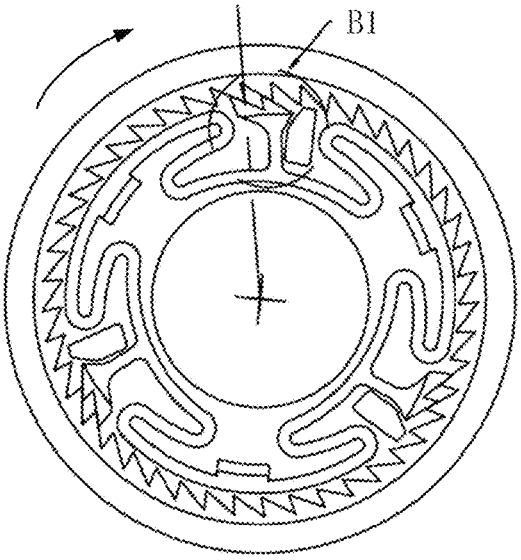
FIG. 14A is a top view of a middle position where a swing arm moves to give way when an external force is applied in a tensioning direction of another embodiment of the lacing device.
Figure 14B:
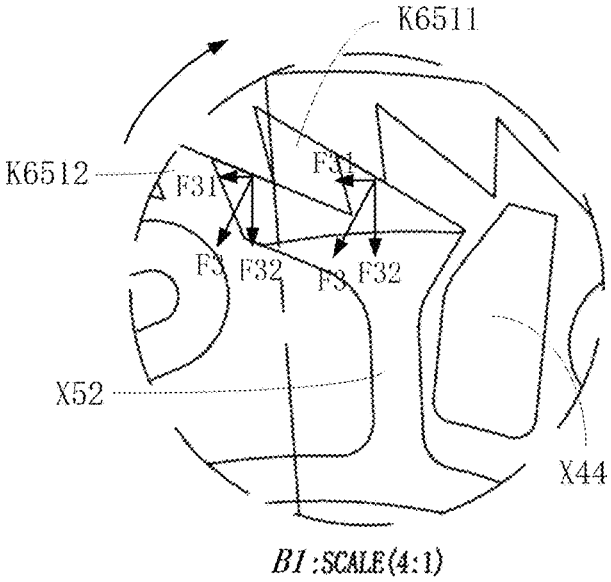
FIG. 14B is a partially enlarged view of a position B1 in FIG. 14A.
Figure 15A:
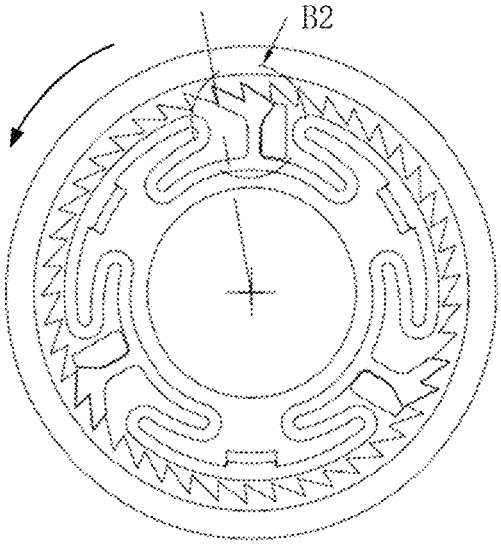
FIG. 15A is a top view of a swing arm-stop piece-gap mechanism when the lacing device shown in FIG. 14A applies an external force in a loosening direction.
Figure 15B:
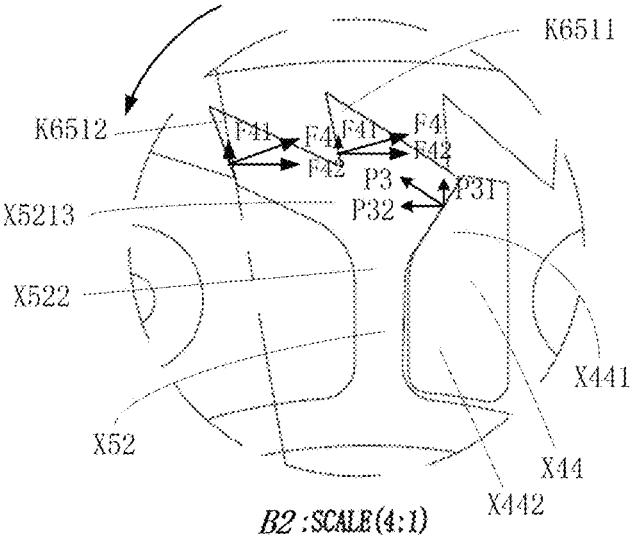
FIG. 15B is a partially enlarged view and a force analysis diagram of a position B2 in FIG. 15A.

The structure of the present embodiment is basically the same as that of Embodiment 1. The only difference is that the arrangement positions of the swing arm-stop piece and the gap are exchanged, that is, in the present embodiment, a swing arm X52-stop piece X44 mechanism is arranged on the rotatable cover, and the gaps K6511 and K6512 are arranged on the housing. In actual use, the swing arm X52-stop piece X44 mechanism rotates with the rotatable cover. The gaps K6511 and K6512 are stationary, and the side walls of the gaps K6511 and K6512 generate resistance to the movement of the swing arm tooth, which makes the swing arm bend and deform to swing and give way. As shown in FIG. 14B, the clockwise direction indicated by the arrow is the direction of tensioning the lace. When the external force is applied to the rotatable cover in the clockwise direction, the side wall of the gap applies reverse resistance F3 (having component forces F31 and F32) to the swing arm tooth to force the swing arm X52 (swing arm head and/or swing arm beam) to be deviated in the counterclockwise direction. The stop piece X44 is located in the clockwise direction of the swing arm, so the stop piece X44 allows the swing arm X52 (swing arm head and/or swing arm beam) to be deviated in the counterclockwise direction to give way, and the rotatable cover can rotate in the clockwise direction. As shown in FIG. 15B, when a counterclockwise rotating force is applied to the rotatable cover, the swing arm X52 tries to rotate in the counterclockwise direction, and the other side walls of the gaps K6511 and K6512 apply reverse resistance F4 (having component forces F41 and F42) to the swing arm tooth to force the swing arm to be deviated in the clockwise direction. However, since the stop piece X44 is located in the clockwise direction of the swing arm X52, the base portion X442 of the stop piece prevents the swing arm beam X522 from deviating in the clockwise direction, and only the swing arm head can be slightly deviated in the clockwise direction until its neck portion X5213 abuts against the wedge-shaped head X441 of the stop piece. The slope surface of the wedge-shaped head X441 applies an oblique upward extrusion force P3 to the swing arm neck X5213. P3 includes an upward component force P31and a circumferential component force P32. The component force P31 keeps the swing arm tooth always engaged with the gap, so the swing arm tooth cannot be disengaged from the gap, and the rotatable cover cannot rotate in the reverse direction. The counter-clockwise direction is the anti-reverse direction.

The difference between the present embodiment and Embodiment 1 is that in the present embodiment, the rotatable direction of the rotatable cover is opposite to that of the swing arm, while in Embodiment 1, the direction in which the swing arm can swing and give way is the same as the rotatable direction of the rotatable cover. The reason for this difference is related to which of the gap and the swing arm is arranged on the driving part, because the force forcing the lateral deviation of the swing arm comes from the pressure of the side wall of the gap on the swing arm tooth. When the gap is arranged on the driving part, the pressure is basically the same as the applied external force, so the deviation direction of the swing arm is the same as the rotatable direction. When the swing arm is arranged on the driving part, the pressure is a reverse force, so the deviation direction of the swing arm is opposite to the rotatable direction.

The descriptions of the first side and the second side of the swing arm and the gap in the present disclosure are consistent. The orientation is based on the assembled state of the rotatable cover and the housing. In other words, the orientation of the actual use state of the swing arm-gap structure is used as the reference. The first side of the gap corresponds to the first side of the swing arm, and the second side of the gap corresponds to the second side of the swing arm. For example: if the left side of the swing arm is identified as the first side, the right side of the swing arm can be identified as the second side.

In other preferred embodiments, three retractable swing arms can also be arranged at intervals, and each retractable swing arm is individually fixed to the housing or the rotatable cover. An excellent anti-reverse effect can also be achieved.

The above descriptions are only preferred embodiments of the present disclosure, which are further detailed descriptions of the present disclosure in conjunction with specific preferred embodiments, and it cannot be considered that the specific implementation of the present disclosure is limited to these descriptions. Any modifications, equivalents, improvements, etc. made within the spirit and principle of the present disclosure shall all fall within the protection scope of the present disclosure.

What is claimed is:

1. A lacing device, comprising: a rotatable cover, a spool, and a housing, wherein the rotatable cover is rotatably arranged on the housing, and the spool is supported by the housing and rotatable relative to the housing;

the rotatable cover is provided with at least one gap;

the spool is configured to roll up at least one lace when rotating in a tensioning direction and release the at least one lace when rotating in a loosening direction;

the housing is provided with a swing arm elastic component, the swing arm elastic component comprises an elastic member and at least one swing arm; the at least one swing arm comprises a swing arm head; and the at least one swing arm comprises a first side and a second side, wherein the first side and the second side are opposite, the swing arm head is configured to engage the at least one gap of the rotatable cover when the at least one swing arm is in an original position, and the swing arm head is configured to deviate from the original position towards the first side or the second side of the at least one swing arm;

the housing is further provided with at least one stop piece, and the at least one stop piece is located on the first side of the at least one swing arm; and the at least one stop piece comprises a wedge-shaped head, and the wedge-shaped head of the at least one stop piece is arranged corresponding to the swing arm head;

when the rotatable cover is subjected to an external force in the tensioning direction, the at least one stop piece and the elastic member are configured to allow displacement of the at least one swing arm relative to the at least one gap of the rotatable cover until the swing arm head is disengaged from the at least one gap of the rotatable cover to allow the rotatable cover to rotate in the tensioning direction; and when the rotatable cover is subjected to an external force in the loosening direction, the external force in the loosening direction is configured to cause a side wall of the at least one gap of the rotatable cover to exert bias pressure on the swing arm head to deviate the swing arm head, at least part of the swing arm head abuts against the wedge-shaped head of the at least one stop piece, and the swing arm head always remains engaged with the at least one gap of the rotatable cover to prevent the rotatable cover from rotating in the loosening direction.

2. The lacing device according to claim 1, wherein the at least one swing arm further comprises a swing arm beam, the at least one stop piece further comprises a base portion, and the base portion of the at least one stop piece is arranged corresponding to the swing arm beam.

3. The lacing device according to claim 2, wherein the swing arm head comprises at least one tooth portion and a neck portion, at least part of the neck portion of the swing arm head abuts against the wedge-shaped head of the at least one stop piece when the rotatable cover is subjected to the external force in the loosening direction, and the base portion of the at least one stop piece is configured to prevent the swing arm beam from deviating towards a first side of the swing arm beam.

4. The lacing device according to claim 3, wherein the wedge-shaped head of the at least one stop piece comprises a slope surface, the slope surface is adjacent to a first side of the neck portion of the swing arm head, a slope top of the slope surface is inclined to a first side of the wedge-shaped head relative to a slope toe of the slope surface, and the slope toe of the slope surface of the wedge-shaped head is adjacent to the base portion of the at least one stop piece.

5. The lacing device according to claim 3, wherein the neck portion of the swing arm head has a first side surface, and the first side surface of the neck portion and a first tooth wall of the tooth portion have an included angle in a range of 60°-120°.

6. The lacing device according to claim 5, wherein a first tooth portion of the at least one tooth portion is adjacent to the first side surface of the neck portion of the swing arm head, and the first side surface of the neck portion and a first tooth wall of the first tooth portion are perpendicular to each other.

7. The lacing device according to claim 3, wherein the neck portion of the swing arm head has a first side surface, and the first side surface is arranged in parallel with a slope surface of the wedge-shaped head of the at least one stop piece.

8. The lacing device according to claim 3, wherein when the at least one swing arm is in the original position, the at least one tooth portion of the swing arm head is engaged with the at least one gap of the rotatable cover.

9. The lacing device according to claim 3, wherein the swing arm head comprises two tooth portions.

10. The lacing device according to claim 2, wherein the at least one swing arm is arranged along a circumference, and the swing arm beam extends in a radial direction of the circumference.

11. The lacing device according to claim 1, wherein the at least one stop piece and the at least one swing arm are arranged separately and in one-to-one correspondence.

12. The lacing device according to claim 1, wherein the elastic member is an elastic base or the elastic member is an elastic ring base composed of at least two elastic bases.

13. The lacing device according to claim 12, wherein the swing arm elastic component is a retractable swing arm ring, the retractable swing arm ring comprises the elastic ring base and the at least one swing arm connected to the elastic ring base; and the at least one swing arm is connected to the housing by the elastic ring base.

14. The lacing device according to claim 1, wherein the elastic member is connected to one or more of the at least one swing arm.

15. A lacing device, comprising: a rotatable cover, a spool, and a housing, wherein the rotatable cover is rotatably arranged on the housing, and the spool is supported by the housing and rotatable relative to the housing;

the housing is provided with at least one gap;

the spool is configured to roll up at least one lace when rotating in a tensioning direction and release the at least one lace when rotating in a loosening direction;

the rotatable cover is provided with a swing arm elastic component, the swing arm elastic component comprises an elastic member and at least one swing arm; the at least one swing arm comprises a swing arm head; and the at least one swing arm comprises a first side and a second side, wherein the first side and the second side are opposite, the swing arm head is configured to engage the at least one gap of the housing when the at least one swing arm is in an original position, and the swing arm head is configured to deviate from the original position towards the first side or the second side of the at least one swing arm;

the rotatable cover is further provided with at least one stop piece, and the at least one stop piece is located on the first side of the at least one swing arm; and the at least one stop piece comprises a wedge-shaped head, and the wedge-shaped head of the at least one stop piece is arranged corresponding to the swing arm head;

when the rotatable cover is subjected to an external force in the tensioning direction, the at least one stop piece and the elastic member is configured to allow displacement of the at least one swing arm relative to the at least one gap of the housing until the swing arm head is disengaged from the at least one gap of the housing to allow the rotatable cover to rotate in the tensioning direction; and when the rotatable cover is subjected to an external force in the loosening direction, the external force in the loosening direction is configured to cause a side wall of the at least one gap of the housing to exert bias pressure on the swing arm head to deviate the swing arm head, at least part of the swing arm head abuts against the wedge-shaped head of the at least one stop piece, and the swing arm head always remains engaged with the at least one gap of the housing to prevent the rotatable cover from rotating in the loosening direction.

16. An anti-reverse mechanism for a lacing device, comprising:

at least one gap;

a swing arm elastic component, comprising an elastic member and at least one swing arm, wherein the elastic member is connected to one or more of the at least one swing arm; the at least one swing arm comprises a swing arm head; and the at least one swing arm comprises a first side and a second side, wherein the first side and the second side are opposite, the swing arm head is configured to engage the at least one gap when the at least one swing arm is in an original position, and the swing arm head is configured to deviate from the original position towards the first side or the second side of the at least one swing arm; and at least one stop piece, wherein the at least one stop piece is located on the first side of the at least one swing arm, and the at least one stop piece and the at least one swing arm are located on a same part and are arranged separately; and the at least one stop piece comprises a wedge-shaped head, and the wedge-shaped head of the at least one stop piece is arranged corresponding to the swing arm head;

when the at least one gap is subjected to an external force in a tensioning direction, the at least one stop piece and the elastic member are configured to allow displacement of the at least one swing arm relative to the at least one gap until the swing arm head is disengaged from the at least one gap to allow the at least one gap to rotate in the tensioning direction; and when the at least one gap is subjected to an external force in a loosening direction, the external force in the loosening direction is configured to cause a side wall of the at least one gap to exert bias pressure on the swing arm head to deviate the swing arm head, at least part of the swing arm head abuts against the wedge-shaped head of the at least one stop piece, and the swing arm head always remains engaged with the at least one gap to prevent the at least one gap from rotating in the loosening direction.

17. The anti-reverse mechanism according to claim 16, wherein the at least one gap comprises an open end, and the open end comprises a first end point and a second end point; the at least one gap further comprises a first side wall and a second side wall, the first end point of the open end is at the first side wall, the second end point of the open end is at the second side wall, and the first end point and the second end point of the at least one gap are located on a circumference of the end points of the at least one gap; and a straight line where the second side wall of the at least one gap extends along and a radius through the second end point of the circumference of the end points of the at least one gap have an included angle in a range of 0°-10°.

18. The anti-reverse mechanism according to claim 17, wherein the swing arm head comprises a tooth portion and a neck portion, and when the at least one swing arm is in the original position, the tooth portion of the swing arm head is engaged with the at least one gap.

19. The anti-reverse mechanism according to claim 18, wherein the neck portion of the swing arm head is configured in a fan ring shape or a trapezoid shape.

20. The anti-reverse mechanism according to claim 16, wherein the at least one swing arm further comprises a swing arm beam, the at least one stop piece further comprises a base portion, and the base portion of the at least one stop piece is arranged corresponding to the swing arm beam.

* * * * *